US008727556B2

(12) United States Patent
Swan

(10) Patent No.: US 8,727,556 B2
(45) Date of Patent: May 20, 2014

(54) INTEGRATED ILLUMINATION DEVICE MOUNT

(75) Inventor: Johnny E. Swan, Virginia Beach, VA (US)

(73) Assignee: S & S Precision, LLC, Virginia Beach, VA (US)

( * ) Notice: Subject to any disclaimer, the term of this patent is extended or adjusted under 35 U.S.C. 154(b) by 387 days.

(21) Appl. No.: 12/932,426

(22) Filed: Feb. 25, 2011

(65) Prior Publication Data

US 2012/0057360 A1 Mar. 8, 2012

Related U.S. Application Data

(60) Provisional application No. 61/402,682, filed on Sep. 2, 2010.

(51) Int. Cl.
*F21V 21/084* (2006.01)
*F41G 1/34* (2006.01)

(52) U.S. Cl.
USPC ..... 362/103; 362/110; 362/191; 362/285; 362/287; 362/418; 362/427

(58) Field of Classification Search
USPC ..... 362/103, 105, 106, 109, 110, 190, 191, 362/287, 427; 42/146
See application file for complete search history.

(56) References Cited

U.S. PATENT DOCUMENTS

| | | | |
|---|---|---|---|
| 1,107,040 | A | 8/1914 | Conde |
| 1,610,092 | A | 10/1924 | Hise |
| 1,613,203 | A | 1/1927 | Shannon |
| 1,946,059 | A | 2/1934 | Buchholz et al. |
| 2,236,736 | A | 9/1938 | Scott |
| 2,296,287 | A | 9/1942 | Leyde |
| 2,346,695 | A | 4/1944 | Miller |
| 2,545,419 | A | 3/1951 | Williams |
| 2,837,630 | A | 6/1958 | Shen |
| 2,972,739 | A | 2/1961 | Opper |
| 3,155,297 | A | 11/1964 | Stumpf |
| 3,348,746 | A | 10/1967 | Stumpf |
| 3,769,663 | A | 11/1973 | Perl |
| 3,834,052 | A | 9/1974 | Steck, III |
| 3,908,950 | A | 9/1975 | Apel |
| 4,008,536 | A | 2/1977 | Adams |
| 4,216,600 | A | 8/1980 | Brueckner et al. |
| 4,462,064 | A | 7/1984 | Schweitzer |
| 4,504,001 | A | 3/1985 | Nichols |

(Continued)

OTHER PUBLICATIONS

Design U.S. Appl. No. 29/395,765, Plate Carrier Vest, filed Mar. 27, 2012, Johnny E. Swan and Andrew C. Borland.

(Continued)

*Primary Examiner* — Thomas Sember
(74) *Attorney, Agent, or Firm* — Kilpatrick Townsend & Stockton LLP

(57) ABSTRACT

Embodiments include a method and apparatus for an integrated illumination device mount and for mounting the integrated illumination device and mount to a firearm or helmet. In some embodiments, the integrated illumination device mount is a low profile mount. In some embodiments, the integrated illumination device mount allows rigid mounting of an illumination device to a rail of a firearm. In other embodiments, the integrated illumination device allows pivotal mounting of the illumination device to a rail of a firearm. In yet other embodiments, the integrated illumination device mount allows pivotal mounting of the illumination device to a rail of a helmet.

15 Claims, 5 Drawing Sheets

(56) References Cited

U.S. PATENT DOCUMENTS

| | | | |
|---|---|---|---|
| 4,639,944 | A | 2/1987 | Lashley et al. |
| 4,750,656 | A | 6/1988 | Bianchi et al. |
| 4,777,754 | A | 10/1988 | Reynolds, Jr. |
| 4,797,793 | A | 1/1989 | Fields |
| 4,905,396 | A | 3/1990 | Bechtel |
| 4,939,863 | A | 7/1990 | Alexander et al. |
| 5,014,892 | A | 5/1991 | Copeland |
| 5,018,653 | A | 5/1991 | Shoemaker |
| 5,033,219 | A | 7/1991 | Johnson et al. |
| 5,040,322 | A | 8/1991 | Iturrey, Jr. |
| 5,054,170 | A | 10/1991 | Otrusina |
| 5,070,437 | A | 12/1991 | Roberts, Sr. |
| 5,122,781 | A | 6/1992 | Saubolle |
| 5,165,782 | A | 11/1992 | Maglica et al. |
| D332,172 | S | 1/1993 | Lewis |
| 5,203,624 | A | 4/1993 | Schier et al. |
| D340,542 | S | 10/1993 | Marlowe |
| 5,265,781 | A | 11/1993 | Nichols |
| 5,267,131 | A | 11/1993 | Anthony et al. |
| D352,165 | S | 11/1994 | Covertson |
| 5,400,008 | A | 3/1995 | Toohey |
| 5,414,405 | A | 5/1995 | Hogg et al. |
| 5,430,967 | A | 7/1995 | Woodman, III et al. |
| 5,436,814 | A | 7/1995 | Hanley |
| 5,438,494 | A | 8/1995 | Harlan |
| 5,469,346 | A | 11/1995 | Haut et al. |
| 5,564,610 | A | 10/1996 | Barron |
| 5,598,958 | A | 2/1997 | Ryan et al. |
| 5,620,120 | A | 4/1997 | Tien |
| 5,622,297 | A | 4/1997 | Rogers et al. |
| 5,633,623 | A | 5/1997 | Campman |
| 5,639,005 | A | 6/1997 | Chouinard |
| 5,644,792 | A | 7/1997 | Tishler et al. |
| 5,671,561 | A | 9/1997 | Johnson et al. |
| 5,697,695 | A | 12/1997 | Lin et al. |
| 5,716,121 | A | 2/1998 | Dubois |
| 5,735,594 | A | 4/1998 | Own |
| 5,771,489 | A | 6/1998 | Snedeker |
| 5,810,221 | A | 9/1998 | Beletsky et al. |
| 5,839,630 | A | 11/1998 | Dunstan et al. |
| 5,850,954 | A | 12/1998 | Dong-Joo |
| 5,865,524 | A | 2/1999 | Campman |
| 5,978,961 | A | 11/1999 | Barker |
| 5,996,115 | A | 12/1999 | Mazelsky |
| 6,012,827 | A | 1/2000 | Caplan et al. |
| 6,059,156 | A | 5/2000 | Lehtinen |
| 6,067,013 | A | 5/2000 | Pejic |
| 6,069,557 | A | 5/2000 | Anglin, Jr. et al. |
| 6,112,448 | A | 9/2000 | Gray et al. |
| 6,148,447 | A | 11/2000 | Bain et al. |
| 6,158,874 | A | 12/2000 | Brustein et al. |
| 6,161,741 | A | 12/2000 | French |
| 6,175,958 | B1 | 1/2001 | Wu |
| 6,185,854 | B1 | 2/2001 | Solinsky et al. |
| 6,190,018 | B1 | 2/2001 | Parsons et al. |
| 6,190,025 | B1 | 2/2001 | Solinsky |
| 6,213,623 | B1 | 4/2001 | Campman |
| 6,276,088 | B1 | 8/2001 | Matthews et al. |
| D452,047 | S | 12/2001 | Ditchfield et al. |
| 6,371,625 | B2 | 4/2002 | Campman |
| 6,393,752 | B1 | 5/2002 | Oliver et al. |
| 6,478,441 | B2 | 11/2002 | Lam |
| 6,499,245 | B1 | 12/2002 | Swan |
| 6,578,311 | B2 | 6/2003 | Danielson et al. |
| 6,616,294 | B1 | 9/2003 | Henry |
| 6,685,067 | B2 | 2/2004 | French |
| 6,722,771 | B1 | 4/2004 | Stephens |
| 6,742,913 | B2 | 6/2004 | Deutsch |
| 6,785,997 | B2 | 9/2004 | Oz |
| 6,793,366 | B2 | 9/2004 | Chun |
| 6,817,727 | B1 | 11/2004 | McFadden |
| 6,910,224 | B2 | 6/2005 | Ikenaga et al. |
| 6,955,279 | B1 | 10/2005 | Mudd et al. |
| 6,976,777 | B1 | 12/2005 | Herold |
| 7,021,790 | B2 | 4/2006 | Parsons |
| 7,096,620 | B2 | 8/2006 | Zeh |
| 7,156,536 | B1 | 1/2007 | McCorkle |
| 7,195,370 | B2 | 3/2007 | Riblett et al. |
| 7,218,142 | B2 | 5/2007 | Nozawa et al. |
| 7,218,241 | B2 | 5/2007 | Kessel et al. |
| 7,226,183 | B2 | 6/2007 | Galli et al. |
| 7,267,453 | B2 | 9/2007 | Chang et al. |
| 7,287,873 | B2 | 10/2007 | Galli |
| 7,290,896 | B2 | 11/2007 | Dallas et al. |
| 7,293,893 | B2 | 11/2007 | Kim |
| 7,395,627 | B2 | 7/2008 | La France et al. |
| 7,434,955 | B2 | 10/2008 | Vickers et al. |
| 7,444,776 | B2 | 11/2008 | Adams |
| 7,458,489 | B1 | 12/2008 | Mudd et al. |
| 7,510,294 | B2 | 3/2009 | Steele et al. |
| 7,517,108 | B2 | 4/2009 | Galli et al. |
| 7,523,583 | B2 | 4/2009 | Cheng |
| 7,534,006 | B2 | 5/2009 | Goswami et al. |
| 7,562,484 | B2 | 7/2009 | Kim |
| 7,682,037 | B1 | 3/2010 | Hose et al. |
| 7,694,450 | B2 | 4/2010 | Keng |
| 7,712,148 | B2 | 5/2010 | Carlson |
| 7,731,385 | B2 | 6/2010 | Spartano et al. |
| 7,735,255 | B1 | 6/2010 | Kincaid et al. |
| 7,736,013 | B2 | 6/2010 | Griffin |
| 7,743,547 | B2 | 6/2010 | Houde-Walter |
| D622,036 | S | 8/2010 | Mason, III |
| 7,827,724 | B1 | 11/2010 | Spinelli |
| 7,836,625 | B2 | 11/2010 | Swan et al. |
| 7,896,518 | B2 | 3/2011 | Holmes et al. |
| D640,417 | S | 6/2011 | Haynes |
| D641,960 | S | 7/2011 | Goff et al. |
| D648,489 | S | 11/2011 | Stockard |
| D652,573 | S | 1/2012 | Rodriguez |
| 8,166,694 | B2 | 5/2012 | Swan |
| D666,363 | S | 8/2012 | Culbertson |
| 8,256,020 | B2 | 9/2012 | Dovner et al. |
| 2002/0096545 | A1 | 7/2002 | Chang |
| 2002/0148865 | A1 | 10/2002 | French |
| 2003/0090893 | A1 | 5/2003 | Nepil |
| 2003/0098323 | A1 | 5/2003 | Taylor et al. |
| 2003/0123254 | A1 | 7/2003 | Brass et al. |
| 2003/0141329 | A1 | 7/2003 | Huang |
| 2004/0000083 | A1 | 1/2004 | Grant, Jr. |
| 2004/0069821 | A1 | 4/2004 | Kobayashi |
| 2004/0145889 | A1 | 7/2004 | Hendricks |
| 2005/0010987 | A1 | 1/2005 | Crye et al. |
| 2005/0180130 | A1 | 8/2005 | Harris et al. |
| 2006/0026888 | A1 | 2/2006 | Cheng et al. |
| 2006/0198132 | A1 | 9/2006 | Trigiani et al. |
| 2006/0236583 | A1 | 10/2006 | Pikielny |
| 2006/0253950 | A1 | 11/2006 | Kerr |
| 2007/0079415 | A1 | 4/2007 | Carlson |
| 2007/0230162 | A1 | 10/2007 | Galli et al. |
| 2008/0205037 | A1 | 8/2008 | Griffin |
| 2008/0235841 | A1 | 10/2008 | McDunn et al. |
| 2009/0122527 | A1 | 5/2009 | Galli |
| 2009/0151036 | A1 | 6/2009 | Joseph |
| 2009/0185854 | A1 | 7/2009 | Adams |
| 2009/0190332 | A1 | 7/2009 | Sharrah |
| 2009/0293334 | A1 | 12/2009 | Swan |
| 2010/0018103 | A1 | 1/2010 | Holmberg |
| 2010/0128470 | A1 | 5/2010 | Swan et al. |
| 2010/0192448 | A1 | 8/2010 | Darian |
| 2010/0229450 | A1* | 9/2010 | Becker et al. ..... 42/90 |
| 2011/0032694 | A1 | 2/2011 | Swan |
| 2011/0131694 | A1 | 6/2011 | Fearon |
| 2011/0209260 | A1 | 9/2011 | Herbener et al. |
| 2011/0231985 | A1 | 9/2011 | Bishop |
| 2011/0249432 | A1 | 10/2011 | Swan et al. |
| 2012/0030986 | A1 | 2/2012 | Swan et al. |

OTHER PUBLICATIONS

U.S. Appl. No. 13/506,182, Plate Carrier Apparatus and Method, filed Apr. 2, 2012, Johnny E. Swan and Andrew C. Borland.

* cited by examiner

INTEGRATED ILLUMINATION DEVICE MOUNT

CROSS-REFERENCE TO RELATED APPLICATIONS

This application claims benefit of U.S. provisional patent application Ser. No. 61/402,682, filed Sep. 2, 2010, which is herein incorporated by reference.

BACKGROUND OF THE INVENTION

1. Field of the Invention

Embodiments generally relate to a mount for an illumination device.

2. Description of the Related Art

Currently, military units, law enforcement agencies, civil services, and civilians use flashlights to provide illumination, e.g., to identify themselves or injured personnel, hazardous areas, and/or other objects or places of interest. Often, these flashlights are weapon or firearm mounted via some form of a mechanical bracket. Most weapon-mounted flashlights require that the end user purchase a flashlight and then a mounting bracket separately in order to mount the flashlight to a standard rail system such as a M1913 Picatinny Rail system. The Picatinny rail or MIL-STD-1913 rail is a bracket used on some firearms in order to provide a standardized mounting platform to the firearm. All of these flashlight mounting brackets require a cylindrical tube shape that must surround the flashlight body in order to securely grab the flashlight, and then the mounting bracket is secured to the M1913 Picatinny Rail System.

Because traditional flashlight mounting brackets require a cylindrical tube shape that must surround the flashlight body in order to securely grab the flashlight (and then the mounting bracket is secured to a rail system such as the M1913 Picatinny Rail System), it is desirable to reshape the traditional flashlight to a form that can serve the purpose of a flashlight body and a mounting bracket to advantageously bring the functionality of both devices into one, thereby reducing material and weight and simplifying the entire assembly altogether. Additionally, there is a need for a device and method which allows the flashlight to be easily moved and secured into a much closer position along the center axis of the weapon (a low profile position) if desired.

With respect to a helmet, typically, mounting a cylindrical flashlight to a curved helmet would be done in a linear fashion, which means that the light would be fastened to the side of the helmet; therefore, it would only project light directly ahead. This method is not necessarily effective for closer proximity task lighting. Additionally, projecting light straight out from the side of the helmet causes the user to turn his or her head towards the task at hand and then turn his or her eyes to meet the linear projection of light, which after a couple of minutes causes undue stress on the user's neck and eyes. There is a need for a device and method for mounting a flashlight to a helmet which allows the user to easily point the flashlight mounted to the helmet exactly where the task at hand is taking place.

SUMMARY OF THE INVENTION

To this end, embodiments advantageously provide a combination device and method including a flashlight or illuminating device body and a mounting bracket in one which is capable of reducing material needed and weight of the mounted flashlight as well as simplifying the mounted illumination device/flashlight.

Embodiments further advantageously provide a device and method which allows a flashlight or illuminating device to be easily moved and secured into a much closer position along the center axis of the weapon or firearm (e.g., a low profile position).

Embodiments also advantageously provide a device and method for mounting a flashlight to a helmet which allows the user to easily direct the flashlight or illuminating device mounted to the helmet exactly where the task at hand is taking place.

Embodiments generally include an apparatus for mounting an illumination device to a rail of a firearm or helmet, comprising a mounting member comprising a first portion integrated with the illumination device, and a second portion connectable to the first portion so that the cooperation of the first and second portions allows mounting of the illumination device to the rail, wherein the mounting member is shaped to cooperate with the shape of a rail section and to positionally retain the second portion of the mounting member on the rail section with respect to a y-axis and a z-axis of the rail when the mounting member is in a slidable relationship with the rail section. Embodiments also include a method of mounting an illumination device to a rail for a firearm, comprising providing a mounting member comprising a first portion integrated with the illumination device, and a second portion connectable to the first portion so that the cooperation of the first and second portions allows mounting of the illumination device to the rail in a low profile position with respect to the rail, the second portion having one or more first holes therethrough, wherein the mounting member is shaped to cooperate with the shape of a rail section and to positionally retain the second portion of the mounting member on the rail section with respect to a y-axis and a z-axis of the rail when the mounting member is in a slidable relationship with the rail section; positioning the mounting member on the rail section; and inserting one or more connecting members through one or more holes through the second portion of the mounting member and into one or more spaces between protrusions of the rail section to positionally secure the mounting member to the rail.

Embodiments also include a method of mounting an illumination device to a rail for a helmet, comprising providing a mounting member comprising a first portion integrated with the illumination device, and a second portion pivotally connectable to the first portion so that the cooperation of the first and second portions allows mounting of the illumination device to the rail in a low profile position with respect to the rail, the second portion having one or more first holes therethrough, wherein the mounting member is shaped to cooperate with the shape of a rail section and to positionally retain the second portion of the mounting member on the rail section with respect to a y-axis and a z-axis of the rail when the mounting member is in a slidable relationship with the rail section; positioning the mounting member on the rail section; and inserting one or more connecting members through one or more holes through the second portion of the mounting member and into one or more holes in the rail section to positionally secure the mounting member to the rail.

BRIEF DESCRIPTION OF THE DRAWINGS

So that the manner in which the above-recited features of embodiments of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
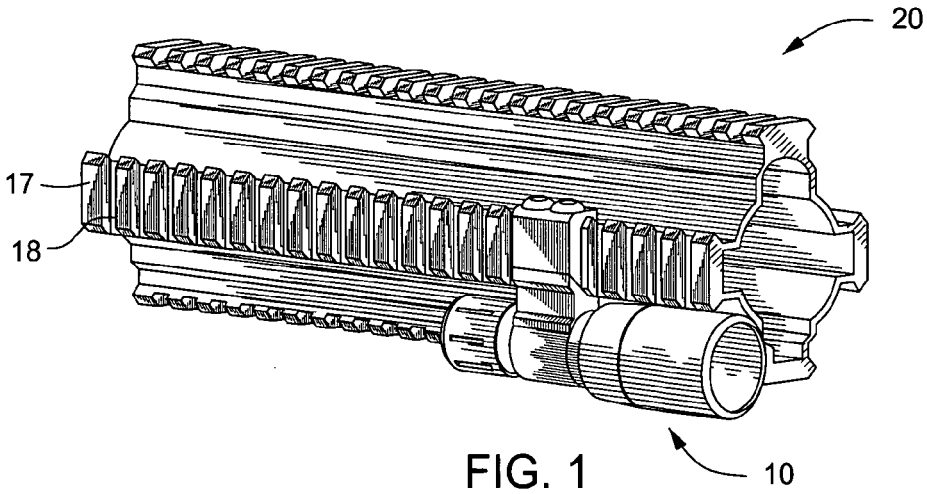
FIG. 1 is a perspective view of an embodiment of a rigid mounting version of an integrated flashlight mount.

Throughout this description and herein, illumination device is interchangeable with flashlight, where the word flashlight is used herein. In other words, where a flashlight is mentioned herein, any other type of illumination device may be used in lieu of the flashlight. Also throughout this description, although the description specifically references attaching the Integrated Flashlight Mount to a firearm or helmet, it is within the scope of embodiments that the Integrated Flashlight Mount may be mounted to other surfaces.

U.S. Patent Publication No. 2009/0100734A1 published on Apr. 23, 2009 (also U.S. patent application Ser. No. 12/287,129 filed on Oct. 6, 2008) having the title "Low Profile Mount and Foregrip for a Firearm" is incorporated by reference herein in its entirety. Also incorporated by reference herein in its entirety is U.S. Patent Publication No. 2009/0293334A1 published on Dec. 3, 2009 (also U.S. patent application Ser. No. 12/386,539 filed on Apr. 20, 2009) having the title "Firearm Fastener." Also incorporated by reference herein in its entirety is U.S. Patent Publication No. 2010/0128470A1 published on May 27, 2010 (also U.S. patent application Ser. No. 12/592,327 filed on Nov. 23, 2009) having the title "Illuminating Device and Method."

Because traditional flashlight mounting brackets require a cylindrical tube shape that must surround the flashlight body in order to securely grab the flashlight (and then the mounting bracket is secured to a rail system such as the M1913 Picatinny Rail System), the ability to reshape the traditional flashlight to a form that can serve the purpose of a flashlight body and a mounting bracket would advantageously bring the functionality of both devices into one, thereby reducing material and weight and simplifying the entire assembly altogether. An additional benefit of integrating the mount into the flashlight body is the ability to rotate or hinge the flashlight body into a much closer position along the center axis of the weapon or firearm (e.g., into a low profile position) if desired by the user. This additional feature allows the end user to choose the desired position of the flashlight and then lock it into place via, for example, one or more fasteners or connecting members.

Embodiments, herein referred to as an Integrated Flashlight Mount or "IFM", provide a flashlight body and mounting bracket in one design. With the mounting features built into the design, the IFM can accommodate a variety of mounting surfaces. Some of these mounting surfaces may be prepared in such a way that they have an industry standard shape that one can readily use (i.e., the M1913 Picatinny Rail standard). Other surfaces may not have a prepared mounting surface (i.e., one or more ventilation slots along the long axis of a rifle hand guard). These unique surfaces may be the ideal location for mounting a flashlight but may not have any mounting surfaces similar to a standard M1913 Picatinny Rail. Whether the desired mounting surface is a standard Picatinny rail, an offset location on the rail or firearm (the offset location(s) or position(s) being between the twelve and three o'clock positions, three and six o'clock positions, six and nine o'clock positions, and/or 9 and twelve o'clock positions on the rail or firearm) via one or more ventilation slots, or some other mounting surface (which may be any mounting surface known to those skilled in the art), the IFM reduces the parts and components necessary in order to mount the flashlight to the desired mounting surface.

In some embodiments, an interior shape of the IFM flashlight body is generally tubular and is capable of receiving one or more batteries, e.g., cylindrically-shaped batteries, inside it. Both ends of the tubular body may be threaded and may receive one or more end caps that may house a switch and a lens and light assembly separately or together.

Figure 2:
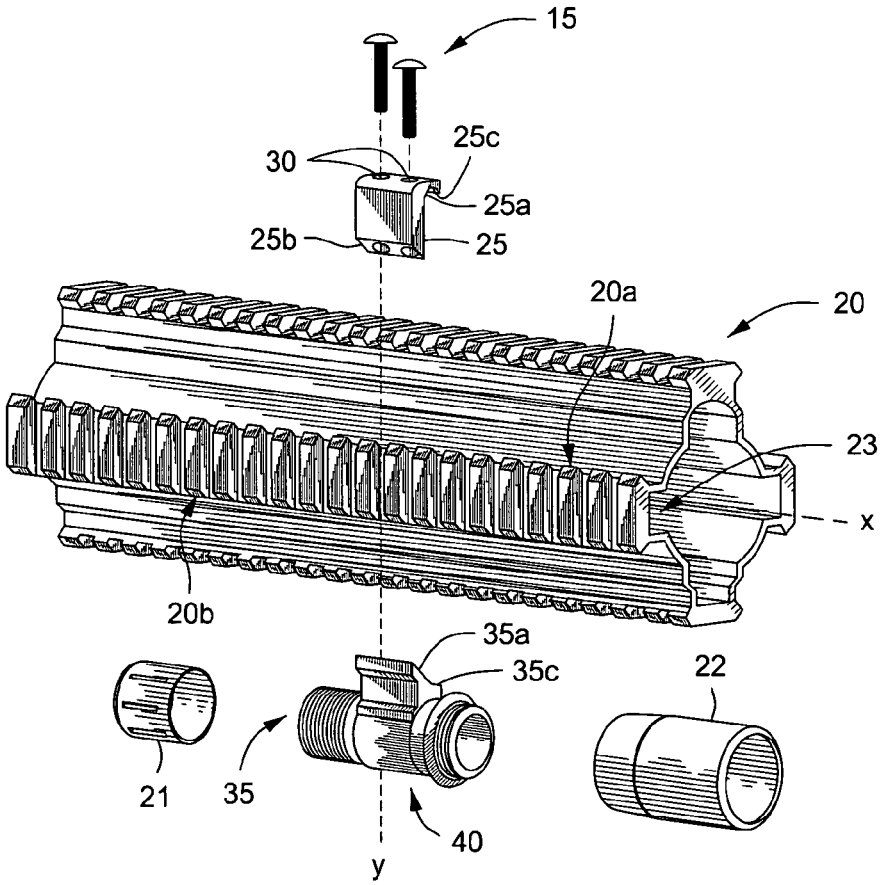
FIG. 2 is an exploded view of the integrated flashlight mount of FIG. 1.

An embodiment of a rigid mounting version of an IFM 10 is shown in FIGS. 1 and 2. As shown in FIGS. 1 and 2, an exterior shape of the IFM flashlight body (Rigid Version) 40 may be mostly generally cylindrical, as are most traditional flashlights, but the exterior may have an additional receiving feature 35 that is capable of receiving the dovetail-style shape of the M1913 Picatinny rail or other similar rails or rail systems. In some embodiments, the IFM flashlight body 40 and receiving feature 35 are integrated with one another and constitute one piece, e.g., a piece formed using the same mold.

To provide the clamping force necessary to mount the IFM 10 to a rail (which may be a Picatinny rail) or rail system 20 for a firearm (not shown), there may be another dovetail-style shape or "rail grabber" 25 and one or more connecting members such as one or more fasteners 15, preferably two fasteners as shown. The rail grabber 25 and receiving feature 35 ultimately cooperate with one another to grab a dovetail-shaped portion of the rail/rail system 20 to securely mount the IFM 10 to the rail/rail system 20, and the one or more connecting members rigidly connect the rail grabber 25 and receiving feature 35 to one another.

The one or more fasteners 15 may be one or more threaded fasteners, such as one or more screws. The one or more fasteners 15 may extend through the rail grabber 25 through one or more corresponding holes 30 and thread into the IFM flashlight body receiving feature 35, e.g., through one or more corresponding holes in the receiving feature 35 (these holes in the receiving feature 35 may extend only partially into the receiving feature 35). The one or more fasteners 15 may extend as shown in FIGS. 1 and 2 through the one or more spaces 18 in between one or more protrusions 17 from the rail/rail system 20. In some embodiments, one of the fasteners 15 extends through one space between protrusions 17 of the rail/rail system 20 and another of the fasteners 15 extends through another space between protrusions 17 of the rail/rail system 20, in a sense "straddling" a protrusion 17 of the rail/rail system 17. In this way, the one or more fasteners 15 extending through the rail spaces 18 prevent movement of the IFM 10 along a length of the rail/rail system 20 (along the x-axis as defined by the dotted line shown in FIG. 1), while the inside dovetail-like shape of the combined rail grabber 25 and receiving feature 35 prevents movement of the IFM 10 upward or downward with respect to the rail/rail system 20 (along the y-axis as defined by the dotted line shown in FIG. 2). Thus, when the complete assembly 10 is placed on the rail or rail system 20, such as the Picatinny rail, for a firearm and the one or more fasteners 15 tightened to the appropriate torque, the IFM flashlight assembly 10 becomes easily clamped or mounted securely to the rail 20. Additionally, the IFM 10 is easily moveable in position along the rail 20, either along the same row 23 to a different position or to a different row of rail protrusions, by and tightening and/or loosening the one or more fasteners 15 via threading or unthreading through the one or more holes 30 (and the corresponding holes through the receiving feature 35) and moving the IFM 10 along the row. (To move the IFM 10 along the x-axis of the rail/rail system 20, the one or more fastening members 15 may be unscrewed/loosened, the IFM 10 may be slid along the rail/rail system 20 section, and upon desired positional placement the one or more fastening members 15 may be tightened/screwed to allow an end of the one or more fastening members 15 to threadedly engage the corresponding holes through the receiving feature 35.) The IFM 10 is also easily lockable into a position along the rail/rail system 20 by screwing/tightening the one or more fasteners 15.

The IFM 10 may include end caps 21, 22 attached to the flashlight body 40. The end caps 21, 22 may be attached via threaded connection to respective ends of the flashlight body 40. It is within the scope of embodiments that only one end cap (either 21 or 22) may be attachable to the flashlight body 40, or instead both end caps 21 and 22 may be attachable to opposite ends of the flashlight body 40. The one or more end caps 21, 22 may house a switch and a lens and light assembly separately or together. Although shown embodiments show the end caps 21, 22 as separate pieces from the flashlight body 40, it is also within the scope of embodiments that the flashlight body 40 and end caps 21, 22 may be the same piece rather than separate, connectable pieces. Similarly, it is within the scope of embodiments that the receiving feature 35 and the flashlight body 40 may either be one piece or may be two pieces rigidly connected to one another.

Furthermore, although the IFM 10 is shown attached and being attachable to the three o'clock position on the rail 20, it may be attached to the rail 20 in any other position along the rail 20 which includes protrusions 17 and spaces 18 therebetween, including but not limited to the six o'clock position, nine o'clock position, and/or twelve o'clock position. Additionally, the IFM 10 may be attached and attachable to one or more ventilation holes through the rail 20 via the fasteners 15, the ventilation holes typically being located between the twelve o'clock and three o'clock position on the rail 20, between the three o'clock and six o'clock position on the rail 20, between the six o'clock position and the nine o'clock position on the rail, and/or between the nine o'clock and twelve o'clock position on the rail 20.

In operation, the IFM flashlight body 40 is placed beneath a rail 20 section so that a portion of the upper surface 35*a* of the receiving feature 35 is in contact with a portion of a lower surface 20*b* of the rail section. The rail grabber 25 lower surface 25*b* is also placed in contact with a portion of the upper surface 35*a* of the receiving piece 35. An inside surface 25*a* of the rail grabber 25 is placed in contact with an upper surface 20*a* of the rail section. The inside surface 25*a* is shaped to fit with a shape of the upper surface 20*a* of the rail section, and the inside surface 25*a* includes an overhanging portion 25*c* which hooks over the upper surface 20*a* of the rail section to help in locking the IFM 40 into position on the rail/rail section 20 with respect to the y-axis and z-axis. Similarly, the upper surface 35*a* of the receiving piece 35 is shaped to fit with a shape of the lower surface 20*b* of the rail section, and the upper surface includes an overhanging portion 35*c* which hooks over the lower surface 20*b* of the rail section to help in locking the IFM 10 into position on the rail/rail section 20 with respect to the y-axis and z-axis.

For the IFM 10 and the rail grabber 25 to be located in a position, the holes 30 and corresponding holes in the upper surface 35*a* of the receiving feature 35 are aligned with spaces 18 between protrusions 17 of the rail/rail section 20. In some embodiments, one hole 30 through the rail grabber 25 and one hole through the upper surface 35*a* are aligned with one space in the rail 20, while another hole 30 through the rail grabber 25 and another hole through the upper surface 35*a* are aligned with an adjacent space in the rail section. The connecting members 15 are placed through the holes 30, through the appropriate spaces in the rail, and through the holes through the upper surface 35*a* of the receiving feature 35. The connecting members 15 are then screwed into the holes to lock the IFM 10 into position. The connecting members 15 lock the IFM 10 into position on the rail 20 with respect to the x-axis, so that ultimately the IFM 10 is locked into position on the rail 20 with respect to all axes. The IFM 10 may be locked on the rail 20 into a low profile position, as shown in FIG. 1.

To unlock the IFM 10, the one or more connecting members 15 are unscrewed from the holes in the upper surface 35*a* of the receiving feature 35 and removed from the spaces in the rail 20. The IFM 10 may easily be moved along the rail section or to another rail section on the rail 20 by again aligning the holes through the rail grabber 25 and the upper surface 35*a* with the desired spaces through the rail section, placing the one or more connecting members 15 through the holes 30 and the spaces on the rail 20 (although it is not necessary to place the connecting members 15 through the holes 30 if they were never removed from the holes in the moving of the rail grabber 25 with respect to the rail 20), and then screwing the one or more connecting members 15 into the holes through the upper surface 35*a*.

Although the operation of the IFM 10 was described above with respect to the upper surface 35*a* of the receiving feature 35 and the lower surface 20*b* of the rail section, as well as with respect to the lower inside surface 25*a* of the rail grabber and upper surface 20*a* of the rail section, it is understood that these directional labels are merely included to describe how the parts and sections of components exist in relation to one another. It is within the contemplation of the inventor of embodiments that the IFM flashlight body 40 and receiving feature 35 may be flipped "upside down" so that the IFM flashlight body 40 exists above the upper surface 20*a* of the rail section and that the receiving feature 35 may also be flipped "upside down" to provide the mating feature below the rail section. Additionally, the terms "upper," "lower," etc. are not limiting of the scope of embodiments, as manipulation of the rail 20 and the firearm associated with the rail 20 may cause the components described herein to no longer be "upper" or "lower" in location with respect to the other components.

Figure 3:
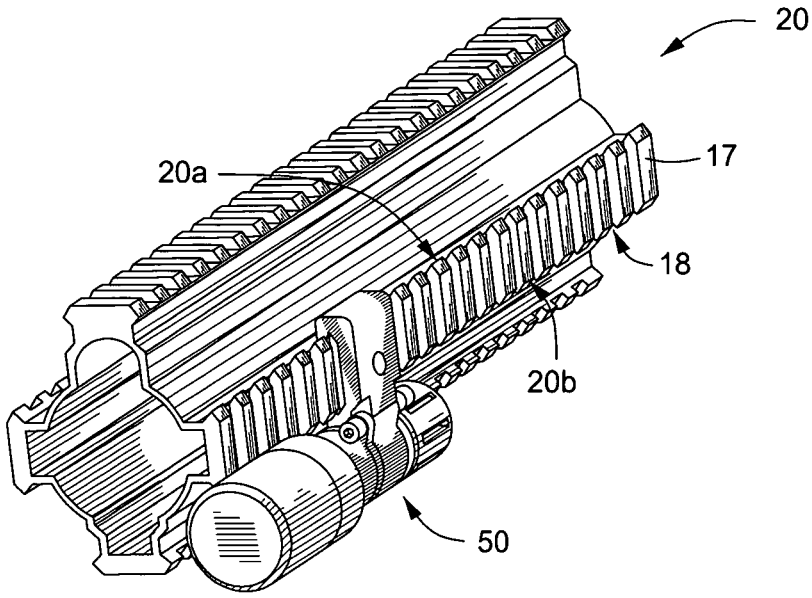
FIG. 3 is a perspective view of an embodiment of a hinge version of an integrated flashlight mount.
Figure 4:
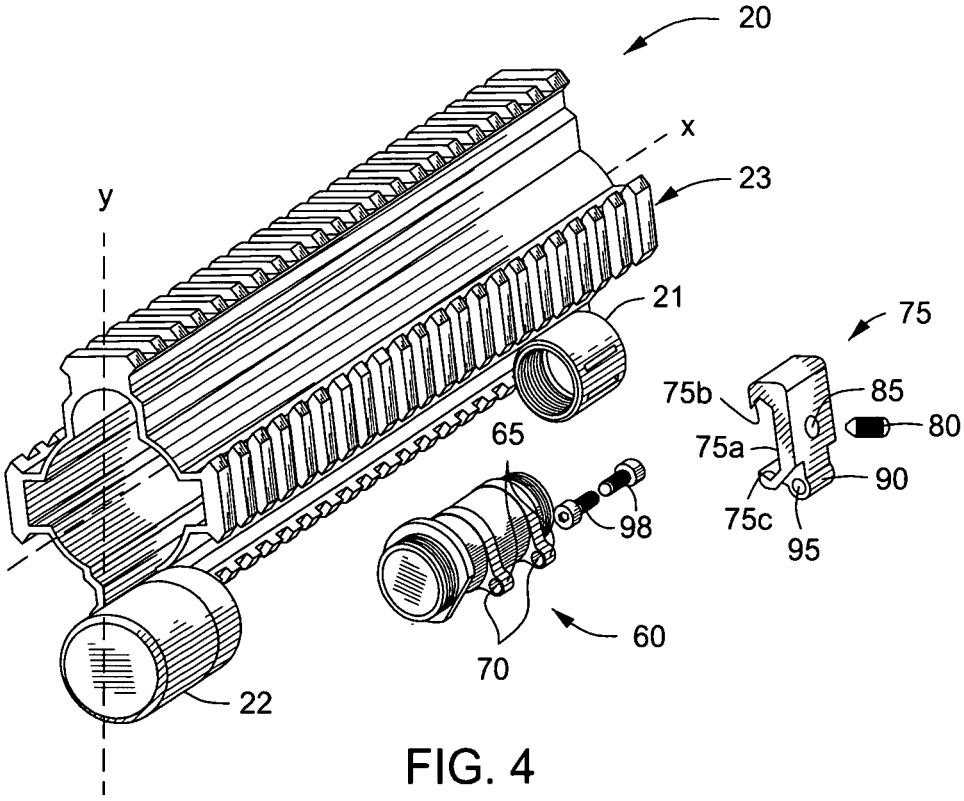
FIG. 4 is an exploded view of the integrated flashlight mount of FIG. 3.

An embodiment of a hinge version of an IFM 50 is illustrated in FIGS. 3 and 4. As shown in FIGS. 3 and 4, an exterior shape of the IFM flashlight body (Hinged Version) may be generally cylindrical and have two features 65 (any number of these features may be used in embodiments, including less than two or more than two) that may be lobe-shaped and protrude from and extend beyond an outer diameter of the main flashlight body 60. One or more through holes 70 may extend through these extended lobes 65, preferably at a location at or near the center of these extended lobes and so that the holes 70 through the lobes 65 are generally parallel to a central axis of the IFM flashlight body 60. In some embodiments, the IFM flashlight body 60 and the extended lobes 65 are integrated with one another and constitute one piece, e.g., a piece formed using the same mold.

A separate "rail grabber" mounting member 75 may clamp and locate securely to a rail 20 such as a Picatinny rail via tension from one or more connecting members, e.g., one or more fasteners 80 such as one or more set screws, through one or more corresponding holes 85 through the rail grabber mounting member 75. The tension may be accomplished via threading of the one or more fasteners 80 into the one or more holes 85. The interior of the rail grabber mounting member 75 may be shaped to generally correspond with an exterior of at least a portion of one of the rows 23 of rail protrusions 17 so that the interior of the rail grabber mounting member 75 generally abuts the exterior of the protrusions 17. The one or more fasteners 80 may extend through the one or more holes 85 into a space 18 between rail protrusions 17. The rail grabber mounting member 75 is easily moveable in position along the rail 20, either along the same row 23 to a different position or to a different row of rail protrusions, by and tightening and/or loosening the one or more fasteners 80 via threading or unthreading through the one or more holes 85 and moving the rail grabber mounting member 75 along the row.

Although the rail grabber mounting member 75 is illustrated in FIGS. 3 and 4 as located on the row 23 of rail protrusions 17 in the three o'clock position on the rail 20, it is within the scope of embodiments that the rail grabber mounting member 75 may instead be located on any other rows of rail protrusions in any other position on the rail 20, such as in the six o'clock position, nine o'clock position, or twelve o'clock position. Additionally, the IFM 50 may be attached and attachable to one or more ventilation holes through the rail 20 via the fasteners 80, the ventilation holes typically being located between the twelve o'clock and three o'clock position on the rail 20, between the three o'clock and six o'clock position on the rail 20, between the six o'clock position and the nine o'clock position on the rail, and/or between the nine o'clock and twelve o'clock position on the rail 20.

The rail grabber piece 75 may include a male feature 90 extending therefrom that may be lobed in shape and sized so that it is capable of fitting in between the lobed features 65 on the flashlight body 60. The male feature 90 of the rail grabber 75 may include one or more threaded through holes 95 extending therethrough, preferably one through hole located at or near the center of its lobed feature. When the IFM flashlight body 60 and rail grabber 75 come together, one or more fasteners 98 extend through the through holes 70 on both sides of the IFM lobed features 65 and thread into the through hole 95 through the lobed feature 90 of the rail grabber 75. The cooperation of the lobed features 65 and 90 and the fastener 98 with one another allows rotation of the IFM flashlight body 60 with respect to the rail 20, with the IFM flashlight body 60 rotatable inward toward the rail 20 and outward away from the rail 20 around the fastener 98. These fastener(s) 98, acting as a hinge mechanism and pivot point, now allow the user to "hinge" the IFM flashlight body 60 closer to the center axis of the firearm or weapon than was previously possible, therefore, creating a much lower profile flashlight.

When the user locates his/her desired placement of the IFM flashlight body 50 rotationally with respect to the rail or rail system 20, the one or more fasteners 98 may be tightened (e.g., via threading into the holes 70 and 95), which locks the IFM 50 flashlight body 60 into position rotationally with respect to its distance and pivotal position towards or away from the rail/rail system 20. Additionally, when the user locates his/her desired placement of the IFM 50 along the rail or rail system 20 upon sliding the rail grabber piece 75 along the length of the rail or rail system 20 (along the x-axis as shown in FIG. 4), the one or more fasteners 80 may be tightened (e.g., via threading into the hole 85), which locks the IFM 50 into position along the length of the rail or rail system 20 (along the x-axis as defined by the dotted line shown in FIG. 4). The one or more fasteners 80 upon their tightening push the rail grabber piece 75 towards the rail/rail system 20 and eventually may, at one end of the one or more fasteners 80, engage the surface of the rail/rail system 20 within a space 18 between protrusions 17 of the rail/rail system 20. Therefore, the IFM 50 is advantageously easily positionable and lockable rotationally towards and away from the rail/rail system 20 as well as along the length of the rail or rail system 20 with respect to its x-axis (as defined by the dotted line shown in FIG. 4). (To move the IFM 50 along the x-axis of the rail/rail system 20, the one or more fastening members 80 may be unscrewed/loosened, the IFM 50 may be slid along the rail/rail system 20, and upon desired positional placement the one or more fastening members 80 may be tightened/screwed to allow an end of the one or more fastening members 80 to engage the surface within another space 18.)

The IFM 50 may include end caps 21, 22 attached to the flashlight body 60. The end caps 21, 22 may be attached via threaded connection to respective ends of the flashlight body 60. It is within the scope of embodiments that only one end cap (either 21 or 22) may be attachable to the flashlight body 60, or instead both end caps 21 and 22 may be attachable to opposite ends of the flashlight body 60. The one or more end caps 21, 22 may house a switch and a lens and light assembly separately or together. Although shown embodiments show the end caps 21, 22 as separate pieces from the flashlight body 60, it is also within the scope of embodiments that the flashlight body 60 and end caps 21, 22 may be the same piece rather than separate, connectable pieces.

In operation, the hinged version of the IFM 50 is assembled by inserting the lobed feature 90 of the rail grabber 75 into the lobed feature 65 of the IFM flashlight body 60. The holes 95 through the lobed feature 90 and the holes 70 through the lobed feature 65 are also generally aligned with one another. The one or more connecting members 98, which may include two connecting members as shown in FIG. 4, are inserted into the lobed feature holes 70, each connecting member 98 threaded into the holes 70 from the outside of the holes 70 through each lobed feature 65. The connecting members 98 are also threaded through the hole 95 through the lobed feature 90, each connecting member 98 threaded into an opposite end of the hole 95. The flashlight body 60 and the rail grabber 75 are pivotable and rotatable with respect to one another to allow easy positioning of the flashlight body 60 with respect to the rail or rail section 20 when the IFM 50 is mounted to the rail or rail section 20 (see below).

The assembled IFM 50 may be located on the rail or rail section 20 by inserting the rail section row into the inner surface 75*a* of the rail grabber 75. The inner surface 75*a* of the rail grabber 75 is shaped to correspond in shape to the outside surface of the rail section row. The inside surface 75*a* of the rail grabber 75, which is preferably generally U-shaped, includes an overhanging portion 75*b*, 75*c* at each end of the U-shape. The overhanging portions 75*b* and 75*c* lock the rail grabber 75 into position with respect to the y-axis and z-axis of the rail or rail section 20. The rail grabber 75 may be slid along the rail or rail section 20 into the desired position.

Once the rail grabber 75 is slid into its desired position on the rail section row, the connecting member 80 is inserted into the hole 85 through the rail grabber 75. In some embodiments, the hole 85 is positioned adjacent to a space 18 in the rail 20 so that ultimately the connecting member 80 is threaded through the hole 85 into the space 18 so that an end of the connecting member 80 is in contact with the outer surface of the rail which exists in the space 18. Threading the connecting member 80 into the hole 85 locks the IFM 50 into position with respect to the x-axis of the rail/rail section 20.

Before or after positioning and locking the rail grabber 75 into position with respect to the rail/rail section 20, the flashlight body 60 may be pivotally/rotationally positioned with respect to the rail grabber 75 by rotating the flashlight body 60 with respect to the rail grabber 75 around the connecting member(s) 98. Once the flashlight body 60 is in the desired position with respect to the rail grabber 75, the connecting member(s) 98 may then be threaded through the holes 70 and 95 to lock the flashlight body 60 into rotational position with respect to the rail grabber 75 (and ultimately with respect to the rail/rail section 20). The flashlight body 60 may thereby be securely locked into the low profile position with respect to the rail/rail section 20 as shown in FIG. 3.

If desired, the location of the IFM 50 with respect to the rail/rail section 20 may easily be moved by unscrewing/unthreading the connecting member 80 to remove it from the space 18, sliding the IFM 50 along the rail/rail section 20 so that the hole 85 is adjacent to another space, and then threading/screwing the connecting member 80 into another space 18. Similarly, the IFM 50 may be moved to another row of the rail/rail section 20 by unscrewing/unthreading the connecting member 80 to remove it from the space 18, sliding the IFM 50 along the rail/rail section 20 row, sliding the IFM 50 along another row of the rail/rail section 20, aligning the hole 85 with another space 18 on the other row, and then screwing or threading the connecting member 80 into the space 18 in the other row.

Also if desired, the flashlight body 60 may be rotated and locked into position with respect to the rail grabber 75 (and ultimately with respect to the rail/rail section 20) by loosening or unscrewing the connecting member(s) 98 from the holes 65 and 90, pivoting/rotating the flashlight body 60 with respect to the rail grabber 75 around the pivot point at the connecting member(s) 98, and then tightening or screwing the connecting member(s) 98 back into the holes 65 and 90 to lock it into position. The IFM 50 is therefore easily moveable and securely lockable into position with respect to the x-axis, y-axis, and z-axis as well as rotationally with respect to the rail/rail section 20.

Although this description of the hinged version of the IFM 50 referred to assembling the IFM 50 prior to positioning and locking the IFM 50 into position on the rail/rail section 20, it is contemplated by the inventor of embodiments that the rail grabber 75 may be positioned and/or locked onto the rail/rail section 20 prior to assembling the IFM 50 together. Furthermore, although the operation of the IFM 50 was described above with respect to the pivotal portion of the IFM 50 and the flashlight body 60 being located below the rail section row, it is understood that these directional labels are merely included to describe how the parts and sections of components exist in relation to one another. It is within the contemplation of inventors of embodiments that the IFM 50 and its pivotal portion and flashlight body 60 may be flipped "upside down" so that the flashlight body 60 exists above the upper surface 20*a* of the rail section. Additionally, the terms "upper," "lower," etc. are not limiting of the scope of embodiments, as manipulation of the rail 20 and the firearm associated with the rail 20 may cause the components described herein to no longer be "upper" or "lower" in location with respect to the other components.

Figure 5:
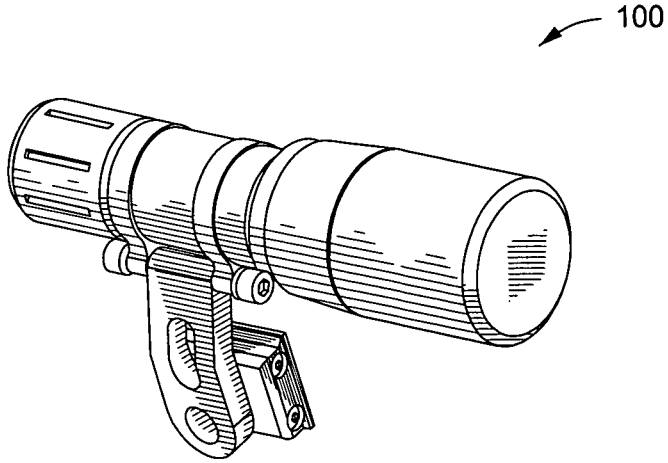
FIG. 5 is a perspective view of an embodiment of a multi-axis helmet version of an integrated flashlight mount.
Figure 6:
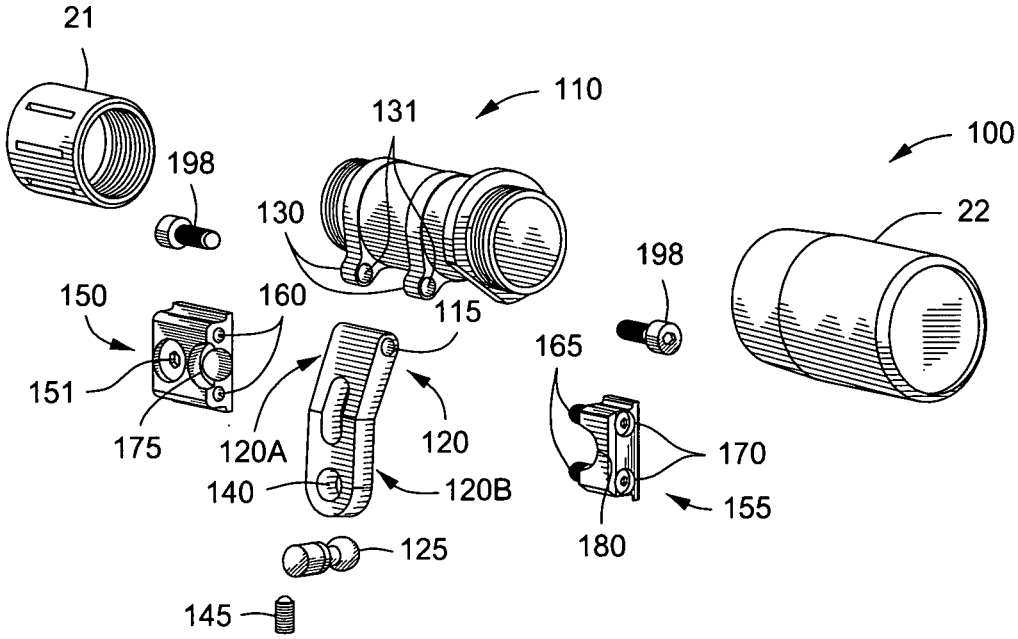
FIG. 6 is an exploded view of the integrated flashlight mount of FIG. 5.

An embodiment of a multi-axis helmet version of an IFM 100 is shown in FIGS. 5 and 6. "Multi-axis" refers to the IFM 100 being rotatable with respect to the helmet around at least two axes, thereby allowing more flexibility in positioning the ultimate location of the resulting illumination via rotational manipulation of the flashlight position with respect to the helmet.

As shown in FIGS. 5 and 6, an additional exterior shape of the IFM flashlight body (helmet version) 110 may be identical to the shape of the exterior of other embodiments of the IFM flashlight body mentioned above. In this embodiment, four additional parts (arm 120, ball joint 125, large dovetail member 150, and small dovetail member 155) make up the final assembly for the helmet version.

The arm 120 may be a generally rectangular curved bar, its upper portion 120A generally rectangular shaped and its lower portion 120B generally rectangular shaped at its upper end and generally curved at its lower end. The upper portion 120A and lower portion 120B may be angled with respect to one another to allow the IFM flashlight body 110 to achieve a low profile position upon mounting the IFM 100 to the helmet. One or more threaded through holes 115 may extend through the upper portion 120A of the arm 120 to mate and generally align with the through holes of a lobed feature 130 (the lobed feature 130 through holes 131 extending therethrough as shown) of the IFM flashlight body 110 and one or more through holes 140 may extend through the lower portion 120B of the arm 120 to receive the ball joint 125. (One or more connecting members, e.g., one or more fasteners 198, may extend through one or more of the holes 131 through the lobed features 130 and through the holes 115 to hingedly and rotationally connect the arm 120 and the IFM flashlight body 110 to one another.) In some embodiments, the IFM flashlight body 110 and the lobed feature 130 are integrated with one another and constitute one piece, e.g., a piece formed using the same mold.

The ball joint 125 may be generally cylindrically shaped with a ball shaped feature on one end. The ball joint 125 may be received in the through hole 140 of the arm 120, and one or more fasteners such as one or more set screws 145 may lock the ball joint 125 into position by extending through a hole (not shown) through the lowermost end of the lower portion 120B of the arm 120 and a corresponding pocket in the ball joint 125 (this pocket being a hole extending partially through the ball joint 125) aligned with that hole through a portion of the arm 120 when the ball joint 125 is located in the hole 140 through the arm 120.

The large dovetail member 150 may be a generally rectangular bar with a dovetail-like shape along both sides of its long axis and one or more threaded through holes for receiving one or more corresponding set screws and one or more threaded blind holes 160, preferably two threaded blind holes therethrough as shown, for receiving one or more corresponding tensioning fasteners 165. The small dovetail member 155 may be a generally rectangular bar (which may be shorter in length than, but the same or similar in width to, the large dovetail 150) with a dovetail-like shape along both sides of its short axis and one or more through holes 170 extending therethrough (preferably two through holes as shown) for receiving one or more tensioning fasteners 165 (preferably two fasteners as shown).

Figure 7:
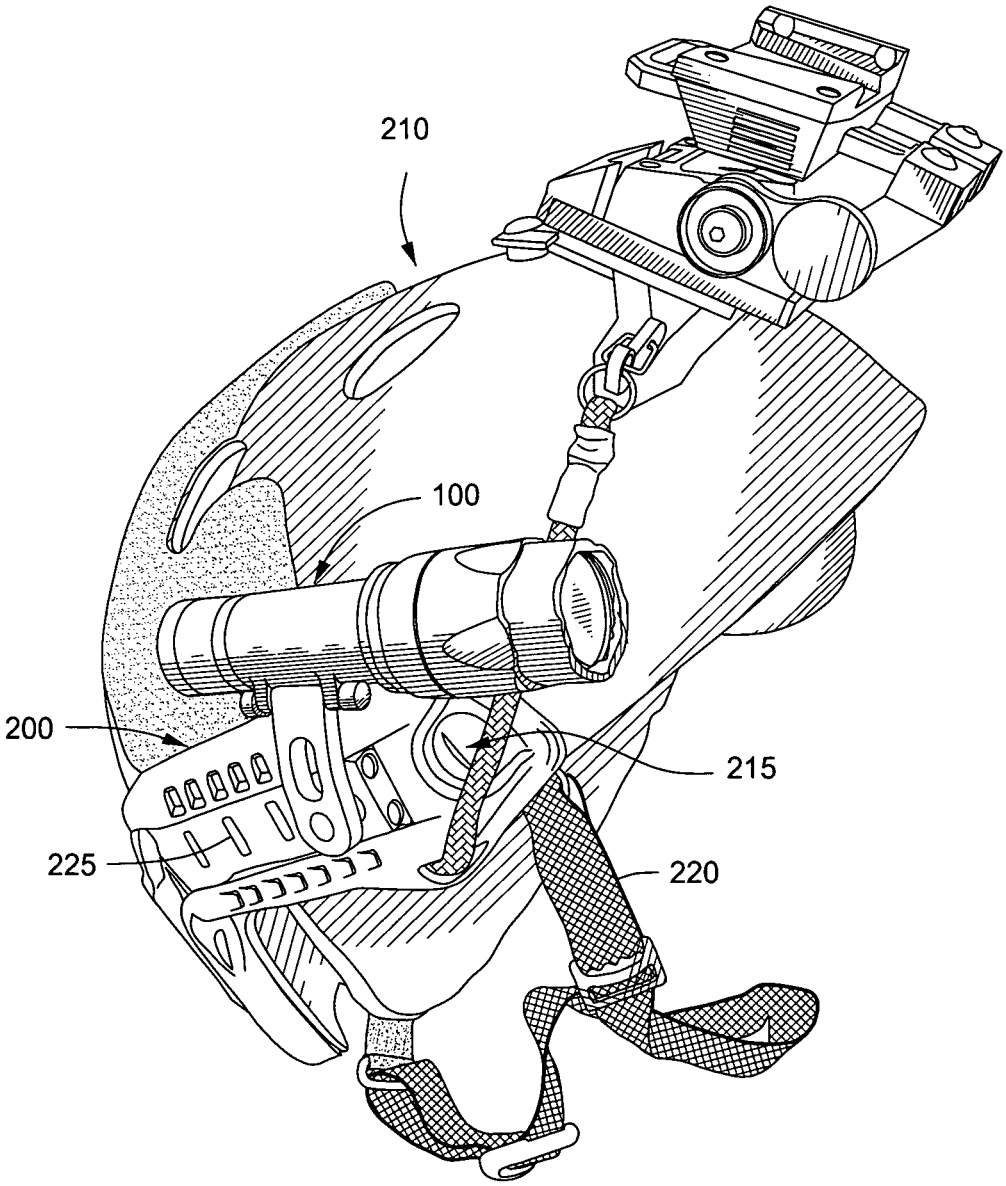
FIG. 7 is a perspective view of the integrated flashlight mount of FIG. 5 attached to a helmet.

The dovetail-like shape of the large and small dovetail members 150, 155 is for slidably mating with corresponding dovetail-like accommodating shapes within a helmet rail or rail system 200, as shown in FIG. 7. (This dovetailing of the dovetail members 150, 155 and the helmet rail 200 prevents movement of the mount for the flashlight upward and downward with respect to a helmet 210, or in other words along the y-axis of the helmet 210, as well as towards and away from the helmet on which the rail 200 is mounted, in other words along the z-axis of the helmet 210, the mount for the flashlight including the small and large dovetail members 150, 155 and the arm 120.) As depicted in FIG. 6, the large dovetail member 150 also may include a hole 151 therethrough for securely attaching the IFM 100 to the helmet rail 200 via locating one or more connecting members such as set screws through the hole 151 and one of the holes 225 through the rail or rail system 200 (see FIG. 7). Locating the one or more connecting members through the holes 151 and 225 additionally secures the dovetail members 150, 155 of the IFM 100 to prevent their movement with respect to the z-axis and x-axis of the rail or rail system 200. Ultimately, the one or more connecting members or set screws within the holes 151 and 225 along with the corresponding dovetailing of the large and small dovetail members 150, 155 with the helmet rail or rail system 200 permits the user to slide and lock the IFM 100 into a secure position with respect to the rail system 200.

As shown in FIG. 7, the helmet rail or rail system 200 may be connected to the helmet 210 via one or more connecting members 215 such as bolts through holes through the helmet 210, the holes also optionally for attaching a chin strap 220 to the helmet 210 via the bolts. These holes are traditionally included through the helmet 210 and the bolts are traditionally used through the holes for chin strap attachment by those skilled in the art.

Both dovetail members 150 and 155 may have a concave generally spherical cut out 175, 180, respectively, on one side which receives the ball feature of the ball joint 125. The one or more tensioning screws 165 simultaneously hold the large dovetail member 150 and small dovetail member 155 together and apply tension to the ball joint 125.

The IFM 100 may include end caps 21, 22 attached to the flashlight body 110. The end caps 21, 22 may be attached via threaded connection to respective ends of the flashlight body 110. It is within the scope of embodiments that only one end cap (either 21 or 22) may be attachable to the flashlight body 110, or instead both end caps 21 and 22 may be attachable to opposite ends of the flashlight body 110. The one or more end caps 21, 22 may house a switch and a lens and light assembly separately or together. Although shown embodiments show the end caps 21, 22 as separate pieces from the flashlight body 110, it is also within the scope of embodiments that the flashlight body 110 and end caps 21, 22 may be the same piece rather than separate, connectable pieces.

This assembly of FIGS. 5 and 6 may be referred to as the "M-Ax Mount" or Multi-Axis mount. It allows the user to connect an illumination device to the standard Ops-Core Helmet "ARC System". Above and beyond simply connecting a flashlight to the helmet rail system, it allows the user to turn and position the flashlight into a desired location. Typically, mounting a cylindrical flashlight to a curved helmet would be done in a linear fashion, which means that the light would be fastened to the side of the helmet; therefore, it would only project light directly ahead. This method may be effective for broadly illuminating a room or an area but is not necessarily effective for closer proximity task lighting. Additionally, projecting light straight out from the side of the helmet causes the user to turn his or her head towards the task at hand and then turn his or her eyes to meet the linear projection of light, which after a couple of minutes causes undue stress on the user's neck and eyes. With the M-Ax mount, the user can turn and twist the ball socket joint by hand and point the flashlight exactly where the task at hand is taking place.

In operation, the IFM 100 is assembled by inserting the ball joint 125 through the hole 140 in the arm 120. The ball joint 125 may then be locked into position with respect to the arm 120 by inserting the one or more connecting members 145 through the one or more holes through the bottom of the arm 120 and screwing/threading the one or more connecting members into the holes and into the pocket through the ball joint 125. The cutout portions 175 and 180 of the large dovetail member 150 and small dovetail member 155 are placed into contact with the ball portion of the ball joint 125, so that the cutout portions 175 and 180 cooperate to make a seat for the ball joint 125, and the one or more connecting members 165 are threaded/screwed into the holes 170 through the small dovetail member 155 and through the holes 160 through the large dovetail member 150 to connect the small and large dovetail members 155, 150 to one another as well as to the ball joint 125 and arm 120.

The IFM flashlight body 110 may be pivotally connected to the arm 120 by inserting the hole 115 through the upper end of the upper portion 120A of the arm 120 into the lobed portion 130 of the IFM flashlight body 110. The hole 115 is aligned with the holes 131 through the lobed portion 130 of the IFM flashlight body 110, and the one or more connecting members 198 may be inserted through the holes 115 and holes 131 through the lobed portion 130 of the flashlight body 110 and screwed/threaded into the holes 115 and holes 131 through the lobed portion 130.

Although in the above description the arm 120 and ball joint 125 are assembled first, the large and small dovetail members 150, 155 and the ball joint 125 next, and the arm 120 and IFM flashlight body 110 last, any order of these three steps is within the scope of embodiments (e.g., the arm 120 and flashlight body 110 may be assembled together prior to the ball joint 125 and arm 120 being assembled together.

The IFM 100 may be assembled with the helmet rail 200 by sliding the connected large and small dovetail members 150, 155 into the cutout portion of the rail 200 as shown in FIG. 7. The upper and lower surfaces of the cutout portion of the rail 200 slidably cooperate with the large and small dovetail members 150, 155 to allow sliding of the IFM 100 along the x-axis of the rail or rail section 200 but prevent movement of the large and small dovetail members 150, 155 along the y-axis or z-axis with of the rail or rail section 200.

When it is desired to lock the large and small dovetail members 150, 155 into position with respect to the x-axis of the rail or rail section 200, the hole 151 through the large dovetail member 150 is generally aligned with one of the holes 225 through the rail or rail section 200. One or more connecting members are inserted into and screwed or threaded into the hole 151 and holes 225 to securely lock the large and small dovetail members 150, 155 into position to prevent their movement with respect to the x-axis, y-axis, and z-axis of the rail or rail section 200.

Figure 8:
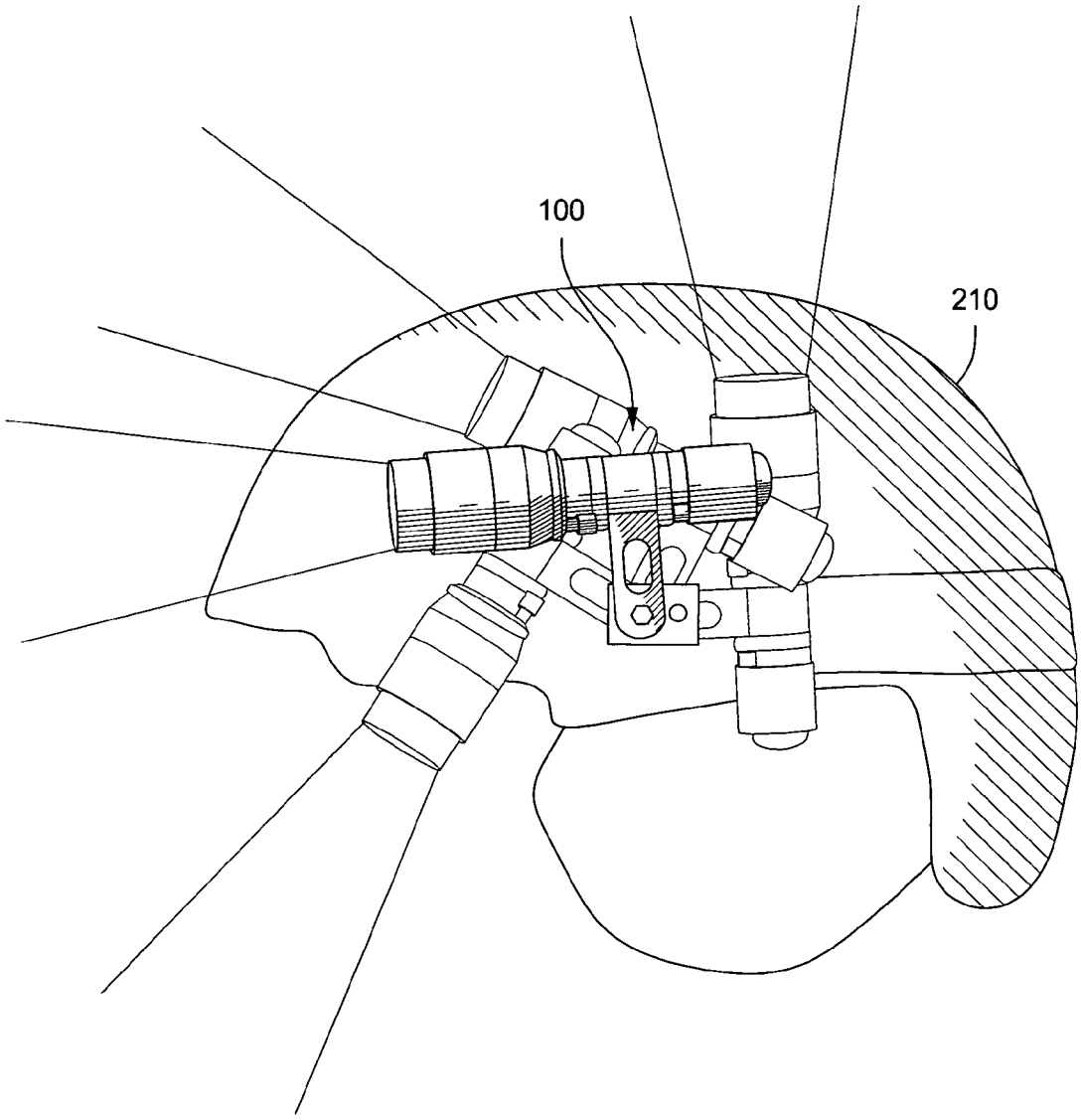
FIG. 8 is a side view of the integrated flashlight mount of FIG. 5 showing a range of motion of the integrated flashlight mount with respect to a helmet.

The IFM 100 permits rotational movement of the arm 120 and flashlight body 110 around the ball joint 125 with respect to the large and small dovetail members 150, 155 (and thereby with respect to the rail or rail section 200 and helmet 210). This rotational movement around a pivot point is shown in FIG. 8. The IFM 100 further permits pivotal movement of the flashlight body 110 around the one or more connecting members 198 with respect to the arm 120 (and thereby with respect to the large and small dovetail members 150, 155, rail or rail section 200, and helmet 210). This pivotal movement of the flashlight body 110 around the one or more connecting members 198 with respect to the arm 120 is arcuate movement towards and away from the helmet 210. To lock the flashlight body 110 into place with respect to the arm 120, the one or more connecting members 198 may be further tightened or threaded into the holes. Due to the pivotal or rotational movement capabilities of the IFM flashlight body 110 along two axes with respect to the helmet 210, the light from the flashlight body 110 may be easily and fluidly directed into the desired position with respect to the helmet 210. The IFM flashlight body 110 is therefore pivotal or rotational with respect to the helmet 210 around at least two axes for quick and easy positioning of the light beam, and the IFM flashlight body 110 is further low profile in its position with respect to the helmet 210 due to the shape of the arm 120 (the angled shape of the lower and upper portions 120B, 120A of the arm 120 which allows positioning of the IFM flashlight body 110 closer to the helmet 210 than the rail 200).

Once assembled, the user may rotate the IFM flashlight body 110 around the ball joint 125 and/or around the pivot point 198 to position the flashlight body 110 as desired. Additionally, the user may change the position of the IFM 100 with respect to x-axis of the rail or rail system 200 by unscrewing or unthreading the one or more connecting members form the holes 151 and 225, slidably moving the IFM 100 along the rail or rail section 200 within the rail cutout so that the hole 151 is generally aligned with a different hole 225 on the rail or rail system 200 (or slidably moving the IFM 100 along the rail or rail section 200 within the rail cutout out of that rail section 200, inserting the IFM 100 into another rail section 200 (not shown), slidably moving the IFM 100 along the other rail section within the rail cutout of that rail section so that the hole 151 is generally aligned with a different hole 225 on the different rail section), and then screwing or threading the one or more connecting members into the hole 151 and the other hole 225 through the rail section 200 or other rail section. Ultimately, quick and easy movement and locking securely into position of the IFM flashlight body 110 is achieved.

Although the operation of the IFM 100 was described above with respect to the IFM flashlight body 110 being located above the rail section row, it is understood that these directional labels are merely included to describe how the parts and sections of components exist in relation to one another. It is within the contemplation of inventors of embodiments that the IFM 100 and flashlight body 110 may be flipped "upside down" so that the IFM flashlight body 110 exists below the lower surface of the rail section 200. Additionally, the terms "upper," "lower," etc. are not limiting of the scope of embodiments, as manipulation of the rail 200 and the helmet 210 associated with the rail 200 may cause the components described herein to no longer be "upper" or "lower" in location with respect to the other components.

The dovetail shape and dovetailing of the IFM 10, 50, and 100 embodiments shown and described herein are not the typical dovetail shape or dovetailing connection. The dovetail shape and dovetailing are merely the phrases used to describe the angular portions of the IFM 10, 50, 100 which are made to fit with and in some instances wrap around the rail 20, 200 angular surfaces of the standard rails 20, 200 known to those skilled in the art.

The IFM is an ideal fusion of illumination device and mounting system in one system. The IFM utilizes a simplified and ergonomic design with multiple attachment methods to make it both versatile and user friendly. A benefit of the IFM is that it gives military and law enforcement units a lower profile mounting solution for weapon mounted flashlights. The IFM also provides for a lower profile mounting solution for helmet mounted flashlights with the ability to direct the illumination to specific tasks at hand, thereby reducing physical strain in doing so.

Some embodiments include a method of mounting an illumination device to a rail for a firearm, comprising providing a mounting member comprising a first portion integrated with the illumination device, and a second portion connectable to the first portion so that the cooperation of the first and second portions allows mounting of the illumination device to the rail, the second portion having one or more first holes therethrough, wherein the mounting member is shaped to cooperate with the shape of a rail section and to positionally retain the second portion of the mounting member on the rail section with respect to a y-axis and a z-axis of the rail when the mounting member is in a slidable relationship with the rail section; positioning the mounting member on the rail section; and inserting one or more connecting members through one or more holes through the second portion of the mounting member and into one or more spaces between protrusions of the rail section to positionally secure the mounting member to the rail. Other embodiments include a method of mounting an illumination device to a rail for a firearm, comprising providing a mounting member comprising a first portion integrated with the illumination device, and a second portion connectable to the first portion so that the cooperation of the first and second portions allows mounting of the illumination device to the rail, the second portion having one or more first holes therethrough, wherein the mounting member is shaped to cooperate with the shape of a rail section and to positionally retain the second portion of the mounting member on the rail section with respect to a y-axis and a z-axis of the rail when the mounting member is in a slidable relationship with the rail section; positioning the mounting member on the rail section; and inserting one or more connecting members through one or more holes through the second portion of the mounting member and into one or more spaces between protrusions of the rail section to positionally secure the mounting member to the rail, the method further comprising inserting the one or more connecting members through one or more holes through the first portion of the mounting member to rigidly connect the first and second mounting members to one another and to positionally secure the illumination device to the rail. Yet other embodiments include a method of mounting an illumination device to a rail for a firearm, comprising providing a mounting member comprising a first portion integrated with the illumination device, and a second portion connectable to the first portion so that the cooperation of the first and second portions allows mounting of the illumination device to the rail, the second portion having one or more first holes therethrough, wherein the mounting member is shaped to cooperate with the shape of a rail section and to positionally retain the second portion of the mounting member on the rail section with respect to a y-axis and a z-axis of the rail when the mounting member is in a slidable relationship with the rail section; positioning the mounting member on the rail section; and inserting one or more connecting members through one or more holes through the second portion of the mounting member and into one or more spaces between protrusions of the rail section to positionally secure the mounting member to the rail, the method further comprising removing the one or more connecting members from the one or more holes through the first portion of the mounting member and from the one or more spaces through the rail section; moving the mounting member and illumination device to a different position on the rail; and inserting the one or more connecting members through one or more different spaces through the rail and through the one or more holes through the first portion of the mounting member to positionally secure the mounting member and illumination device to the rail.

Other embodiments include a method of mounting an illumination device to a rail for a firearm, comprising providing a mounting member comprising a first portion integrated with the illumination device, and a second portion connectable to the first portion so that the cooperation of the first and second portions allows mounting of the illumination device to the rail, the second portion having one or more first holes therethrough, wherein the mounting member is shaped to cooperate with the shape of a rail section and to positionally retain the second portion of the mounting member on the rail section with respect to a y-axis and a z-axis of the rail when the mounting member is in a slidable relationship with the rail section; positioning the mounting member on the rail section; and inserting one or more connecting members through one or more holes through the second portion of the mounting member and into one or more spaces between protrusions of the rail section to positionally secure the mounting member to the rail, the method further comprising pivotally connecting the first portion of the mounting member to the second portion of the mounting member to allow rotation of the illumination device relative to the second mounting member. Further embodiments include a method of mounting an illumination device to a rail for a firearm, comprising providing a mounting member comprising a first portion integrated with the illumination device, and a second portion connectable to the first portion so that the cooperation of the first and second portions allows mounting of the illumination device to the rail, the second portion having one or more first holes therethrough, wherein the mounting member is shaped to cooperate with the shape of a rail section and to positionally retain the second portion of the mounting member on the rail section with respect to a y-axis and a z-axis of the rail when the mounting member is in a slidable relationship with the rail section; positioning the mounting member on the rail section; and inserting one or more connecting members through one or more holes through the second portion of the mounting member and into one or more spaces between protrusions of the rail section to positionally secure the mounting member to the rail, the method further comprising pivotally connecting the first portion of the mounting member to the second portion of the mounting member to allow rotation of the illumination device relative to the second mounting member, wherein pivotally connecting the first portion to the second portion comprises aligning one or more holes through one or more lobed extensions from the first mounting member with one or more holes through one or more lobed extensions from the second mounting member; and inserting one or more connecting members through the one or more holes through the one or more lobed extensions from the first and second mounting members.

Yet further embodiments include a method of mounting an illumination device to a rail for a firearm, comprising providing a mounting member comprising a first portion integrated with the illumination device, and a second portion connectable to the first portion so that the cooperation of the first and second portions allows mounting of the illumination device to the rail, the second portion having one or more first holes therethrough, wherein the mounting member is shaped to cooperate with the shape of a rail section and to positionally retain the second portion of the mounting member on the rail section with respect to a y-axis and a z-axis of the rail when the mounting member is in a slidable relationship with the rail section; positioning the mounting member on the rail section; and inserting one or more connecting members through one or more holes through the second portion of the mounting member and into one or more spaces between protrusions of the rail section to positionally secure the mounting member to the rail, the method further comprising pivotally connecting the first portion of the mounting member to the second portion of the mounting member to allow rotation of the illumination device relative to the second mounting member, wherein pivotally connecting the first portion to the second portion comprises aligning one or more holes through one or more lobed extensions from the first mounting member with one or more holes through one or more lobed extensions from the second mounting member; and inserting one or more connecting members through the one or more holes through the one or more lobed extensions from the first and second mounting members, the method further comprising locking the illumination device into a pivotal position with respect to the rail by screwing the one or more connecting members into the aligned holes through the lobed extensions. Other embodiments include a method of mounting an illumination device to a rail for a firearm, comprising providing a mounting member comprising a first portion integrated with the illumination device, and a second portion connectable to the first portion so that the cooperation of the first and second portions allows mounting of the illumination device to the rail, the second portion having one or more first holes therethrough, wherein the mounting member is shaped to cooperate with the shape of a rail section and to positionally retain the second portion of the mounting member on the rail section with respect to a y-axis and a z-axis of the rail when the mounting member is in a slidable relationship with the rail section; positioning the mounting member on the rail section; and inserting one or more connecting members through one or more holes through the second portion of the mounting member and into one or more spaces between protrusions of the rail section to positionally secure the mounting member to the rail, the method further comprising pivotally connecting the first portion of the mounting member to the second portion of the mounting member to allow rotation of the illumination device relative to the second mounting member, the method further comprising pivoting the illumination device into a low profile position relative to the rail by rotating the first mounting member with respect to the second mounting member.

Additional embodiments include a method of mounting an illumination device to a rail for a helmet, comprising providing a mounting member comprising a first portion integrated with the illumination device, and a second portion pivotally connectable to the first portion so that the cooperation of the first and second portions allows mounting of the illumination device to the rail, the second portion having one or more first holes therethrough, wherein the mounting member is shaped to cooperate with the shape of a rail section and to positionally retain the second portion of the mounting member on the rail section with respect to a y-axis and a z-axis of the rail when the mounting member is in a slidable relationship with the rail section; positioning the mounting member on the rail section; and inserting one or more connecting members through one or more holes through the second portion of the mounting member and into one or more holes in the rail section to positionally secure the mounting member to the rail. Further embodiments include a method of mounting an illumination device to a rail for a helmet, comprising providing a mounting member comprising a first portion integrated with the illumination device, and a second portion pivotally connectable to the first portion so that the cooperation of the first and second portions allows mounting of the illumination device to the rail, the second portion having one or more first holes therethrough, wherein the mounting member is shaped to cooperate with the shape of a rail section and to positionally retain the second portion of the mounting member on the rail section with respect to a y-axis and a z-axis of the rail when the mounting member is in a slidable relationship with the rail section; positioning the mounting member on the rail section; and inserting one or more connecting members through one or more holes through the second portion of the mounting member and into one or more holes in the rail section to positionally secure the mounting member to the rail, wherein the second portion of the mounting member further comprises a slidable portion shaped to cooperate with the shape of the rail section and to positionally retain the slidable portion on the rail section with respect to a y-axis and a z-axis of the rail when the slidable portion is engaged in a slidable relationship with the rail section, and an arm which is rotatable with respect to the slidable portion, the arm pivotally connectable to the first portion of the mounting member.

Yet other embodiments include a method of mounting an illumination device to a rail for a helmet, comprising providing a mounting member comprising a first portion integrated with the illumination device, and a second portion pivotally connectable to the first portion so that the cooperation of the first and second portions allows mounting of the illumination device to the rail, the second portion having one or more first holes therethrough, wherein the mounting member is shaped to cooperate with the shape of a rail section and to positionally retain the second portion of the mounting member on the rail section with respect to a y-axis and a z-axis of the rail when the mounting member is in a slidable relationship with the rail section; positioning the mounting member on the rail section; and inserting one or more connecting members through one or more holes through the second portion of the mounting member and into one or more holes in the rail section to positionally secure the mounting member to the rail, wherein the second portion of the mounting member further comprises a slidable portion shaped to cooperate with the shape of the rail section and to positionally retain the slidable portion on the rail section with respect to a y-axis and a z-axis of the rail when the slidable portion is engaged in a slidable relationship with the rail section, and an arm which is rotatable with respect to the slidable portion, the arm pivotally connectable to the first portion of the mounting member, the method further comprising connecting the arm and slidable portion to one another so that the arm is rotatable relative to the slidable portion along a first axis; and pivotally connecting the arm to the first portion of the mounting member so that the first portion of the mounting member is pivotal along a second axis towards and away from the rail section. Further embodiments include a method of mounting an illumination device to a rail for a helmet, comprising providing a mounting member comprising a first portion integrated with the illumination device, and a second portion pivotally connectable to the first portion so that the cooperation of the first and second portions allows mounting of the illumination device to the rail, the second portion having one or more first holes therethrough, wherein the mounting member is shaped to cooperate with the shape of a rail section and to positionally retain the second portion of the mounting member on the rail section with respect to a y-axis and a z-axis of the rail when the mounting member is in a slidable relationship with the rail section; positioning the mounting member on the rail section; and inserting one or more connecting members through one or more holes through the second portion of the mounting member and into one or more holes in the rail section to positionally secure the mounting member to the rail, wherein the second portion of the mounting member further comprises a slidable portion shaped to cooperate with the shape of the rail section and to positionally retain the slidable portion on the rail section with respect to a y-axis and a z-axis of the rail when the slidable portion is engaged in a slidable relationship with the rail section, and an arm which is rotatable with respect to the slidable portion, the arm pivotally connectable to the first portion of the mounting member, the method further comprising connecting the arm and slidable portion to one another so that the arm is rotatable relative to the slidable portion along a first axis; and pivotally connecting the arm to the first portion of the mounting member so that the first portion of the mounting member is pivotal along a second axis towards and away from the rail section, the method further comprising pivoting the first portion of the mounting member with respect to the arm so that the illumination device is located in a first position relative to the rail; manipulating one or more connecting members through one or more lobed features of the first portion of the mounting member and through one or more holes extending through the arm to lock the first portion of the mounting member into the first position, the connecting members forming a pivot point for pivoting the first portion with respect to the arm.

Yet further embodiments include a method of mounting an illumination device to a rail for a helmet, comprising providing a mounting member comprising a first portion integrated with the illumination device, and a second portion pivotally connectable to the first portion so that the cooperation of the first and second portions allows mounting of the illumination device to the rail, the second portion having one or more first holes therethrough, wherein the mounting member is shaped to cooperate with the shape of a rail section and to positionally retain the second portion of the mounting member on the rail section with respect to a y-axis and a z-axis of the rail when the mounting member is in a slidable relationship with the rail section; positioning the mounting member on the rail section; and inserting one or more connecting members through one or more holes through the second portion of the mounting member and into one or more holes in the rail section to positionally secure the mounting member to the rail, wherein the second portion of the mounting member further comprises a slidable portion shaped to cooperate with the shape of the rail section and to positionally retain the slidable portion on the rail section with respect to a y-axis and a z-axis of the rail when the slidable portion is engaged in a slidable relationship with the rail section, and an arm which is rotatable with respect to the slidable portion, the arm pivotally connectable to the first portion of the mounting member, the method further comprising connecting the arm and slidable portion to one another so that the arm is rotatable relative to the slidable portion along a first axis; and pivotally connecting the arm to the first portion of the mounting member so that the first portion of the mounting member is pivotal along a second axis towards and away from the rail section, the method further comprising pivoting the first portion of the mounting member with respect to the arm so that the illumination device is located in a first position relative to the rail; manipulating one or more connecting members through one or more lobed features of the first portion of the mounting member and through one or more holes extending through the arm to lock the first portion of the mounting member into the first position, the connecting members forming a pivot point for pivoting the first portion with respect to the arm, wherein the first position is a low profile position with respect to the rail. Other embodiments include a method of mounting an illumination device to a rail for a helmet, comprising providing a mounting member comprising a first portion integrated with the illumination device, and a second portion pivotally connectable to the first portion so that the cooperation of the first and second portions allows mounting of the illumination device to the rail, the second portion having one or more first holes therethrough, wherein the mounting member is shaped to cooperate with the shape of a rail section and to positionally retain the second portion of the mounting member on the rail section with respect to a y-axis and a z-axis of the rail when the mounting member is in a slidable relationship with the rail section; positioning the mounting member on the rail section; and inserting one or more connecting members through one or more holes through the second portion of the mounting member and into one or more holes in the rail section to positionally secure the mounting member to the rail, wherein the second portion of the mounting member further comprises a slidable portion shaped to cooperate with the shape of the rail section and to positionally retain the slidable portion on the rail section with respect to a y-axis and a z-axis of the rail when the slidable portion is engaged in a slidable relationship with the rail section, and an arm which is rotatable with respect to the slidable portion, the arm pivotally connectable to the first portion of the mounting member, the method further comprising connecting the arm and slidable portion to one another so that the arm is rotatable relative to the slidable portion along a first axis; and pivotally connecting the arm to the first portion of the mounting member so that the first portion of the mounting member is pivotal along a second axis towards and away from the rail section, the method further comprising rotating the arm with respect to the slidable portion using a ball joint extending through a hole through the arm and into a cutout portion in the slidable portion; and locking the arm into position with respect to the slidable portion using one or more connecting members through one or more holes extending through the ball joint.

Embodiments also include an apparatus for mounting an illumination device to a rail of a firearm or helmet, comprising a mounting member comprising a first portion integrated with the illumination device, and a second portion connectable to the first portion so that the cooperation of the first and second portions allows mounting of the illumination device to the rail, wherein the mounting member is shaped to cooperate with the shape of a rail section and to positionally retain the second portion of the mounting member on the rail section with respect to a y-axis and a z-axis of the rail when the mounting member is in a slidable relationship with the rail section. Further embodiments include an apparatus for mounting an illumination device to a rail of a firearm or helmet, comprising a mounting member comprising a first portion integrated with the illumination device, and a second portion connectable to the first portion so that the cooperation of the first and second portions allows mounting of the illumination device to the rail, wherein the mounting member is shaped to cooperate with the shape of a rail section and to positionally retain the second portion of the mounting member on the rail section with respect to a y-axis and a z-axis of the rail when the mounting member is in a slidable relationship with the rail section, wherein the mounting member further comprises one or more connecting members which cooperate with one or more spaces between protrusions of the rail section to retain the mounting member with respect to the x-axis of the rail and prevent slidable movement of the mounting member with respect to the rail section.

Other embodiments include an apparatus for mounting an illumination device to a rail of a firearm or helmet, comprising a mounting member comprising a first portion integrated with the illumination device, and a second portion connectable to the first portion so that the cooperation of the first and second portions allows mounting of the illumination device to the rail, wherein the mounting member is shaped to cooperate with the shape of a rail section and to positionally retain the second portion of the mounting member on the rail section with respect to a y-axis and a z-axis of the rail when the mounting member is in a slidable relationship with the rail section, wherein the mounting member further comprises one or more connecting members which cooperate with one or more spaces between protrusions of the rail section to retain the mounting member with respect to the x-axis of the rail and prevent slidable movement of the mounting member with respect to the rail section, and the one or more connecting members tensionally connect the mounting member to the rail section by threading through one or more holes through the mounting member and into the one or more spaces between protrusions, wherein the one or more holes through the mounting member are one or more holes through the second portion of the mounting member, and the second portion of the mounting member further comprises one or more first lobed extensions therefrom comprising one or more holes therethrough, the one or more holes through the one or more first lobed extensions being generally perpendicular to the one or more holes through the second portion of the mounting member, and wherein the first portion of the mounting member comprises one or more second lobed extensions from the illuminating device, the one or more second lobed extensions from the illuminating device having one or more holes extending therethrough, the central axes of the one or more holes through the one or more second lobed extensions being generally parallel to the central axis of the illuminating device. Yet other embodiments include an apparatus for mounting an illumination device to a rail of a firearm or helmet, comprising a mounting member comprising a first portion integrated with the illumination device, and a second portion connectable to the first portion so that the cooperation of the first and second portions allows mounting of the illumination device to the rail, wherein the mounting member is shaped to cooperate with the shape of a rail section and to positionally retain the second portion of the mounting member on the rail section with respect to a y-axis and a z-axis of the rail when the mounting member is in a slidable relationship with the rail section, wherein the mounting member further comprises one or more connecting members which cooperate with one or more spaces between protrusions of the rail section to retain the mounting member with respect to the x-axis of the rail and prevent slidable movement of the mounting member with respect to the rail section, and the one or more connecting members tensionally connect the mounting member to the rail section by threading through one or more holes through the mounting member and into the one or more spaces between protrusions, wherein the one or more holes through the mounting member are one or more holes through the second portion of the mounting member, and the second portion of the mounting member further comprises one or more first lobed extensions therefrom comprising one or more holes therethrough, the one or more holes through the one or more first lobed extensions being generally perpendicular to the one or more holes through the second portion of the mounting member, and wherein the first portion of the mounting member comprises one or more second lobed extensions from the illuminating device, the one or more second lobed extensions from the illuminating device having one or more holes extending therethrough, the central axes of the one or more holes through the one or more second lobed extensions being generally parallel to the central axis of the illuminating device, the apparatus further comprising one or more pivot point members extending through the holes through the first lobed extensions and second lobed extensions when the one or more cooperating holes through the first and second lobed extensions are generally aligned with one another to allow pivoting of the illuminating device and first portion of the mounting member with respect to the second portion of the mounting member.

Embodiments also include an apparatus for mounting an illumination device to a rail of a firearm or helmet, comprising a mounting member comprising a first portion integrated with the illumination device, and a second portion connectable to the first portion so that the cooperation of the first and second portions allows mounting of the illumination device to the rail, wherein the mounting member is shaped to cooperate with the shape of a rail section and to positionally retain the second portion of the mounting member on the rail section with respect to a y-axis and a z-axis of the rail when the mounting member is in a slidable relationship with the rail section, wherein the mounting member further comprises one or more connecting members which cooperate with one or more spaces between protrusions of the rail section to retain the mounting member with respect to the x-axis of the rail and prevent slidable movement of the mounting member with respect to the rail section, and the one or more connecting members tensionally connect the mounting member to the rail section by threading through one or more holes through the mounting member and into the one or more spaces between protrusions, wherein the one or more holes through the mounting member are one or more holes through the second portion of the mounting member, and the second portion of the mounting member further comprises one or more first lobed extensions therefrom comprising one or more holes therethrough, the one or more holes through the one or more first lobed extensions being generally perpendicular to the one or more holes through the second portion of the mounting member, and wherein the first portion of the mounting member comprises one or more second lobed extensions from the illuminating device, the one or more second lobed extensions from the illuminating device having one or more holes extending therethrough, the central axes of the one or more holes through the one or more second lobed extensions being generally parallel to the central axis of the illuminating device, the apparatus further comprising one or more pivot point members extending through the holes through the first lobed extensions and second lobed extensions when the one or more cooperating holes through the first and second lobed extensions are generally aligned with one another to allow pivoting of the illuminating device and first portion of the mounting member with respect to the second portion of the mounting member, wherein the one or more pivot point members comprise one or more connecting members, and wherein the one or more connecting members are capable of locking the illuminating device into position with respect to the second portion of the mounting member upon their threading into the holes through the one or more first lobed extensions and the holes through the one or more second lobed extensions. Further embodiments include an apparatus for mounting an illumination device to a rail of a firearm or helmet, comprising a mounting member comprising a first portion integrated with the illumination device, and a second portion connectable to the first portion so that the cooperation of the first and second portions allows mounting of the illumination device to the rail, wherein the mounting member is shaped to cooperate with the shape of a rail section and to positionally retain the second portion of the mounting member on the rail section with respect to a y-axis and a z-axis of the rail when the mounting member is in a slidable relationship with the rail section, wherein the mounting member further comprises one or more connecting members which cooperate with one or more spaces between protrusions of the rail section to retain the mounting member with respect to the x-axis of the rail and prevent slidable movement of the mounting member with respect to the rail section, and the one or more connecting members tensionally connect the mounting member to the rail section by threading through one or more holes through the mounting member and into the one or more spaces between protrusions, wherein the one or more holes through the mounting member are one or more holes through the second portion of the mounting member, and the second portion of the mounting member further comprises one or more first lobed extensions therefrom comprising one or more holes therethrough, the one or more holes through the one or more first lobed extensions being generally perpendicular to the one or more holes through the second portion of the mounting member, and wherein the first portion of the mounting member comprises one or more second lobed extensions from the illuminating device, the one or more second lobed extensions from the illuminating device having one or more holes extending therethrough, the central axes of the one or more holes through the one or more second lobed extensions being generally parallel to the central axis of the illuminating device, the apparatus further comprising one or more pivot point members extending through the holes through the first lobed extensions and second lobed extensions when the one or more cooperating holes through the first and second lobed extensions are generally aligned with one another to allow pivoting of the illuminating device and first portion of the mounting member with respect to the second portion of the mounting member, wherein the one or more pivot point members comprise one or more connecting members, and wherein the one or more connecting members are capable of locking the illuminating device into position with respect to the second portion of the mounting member upon their threading into the holes through the one or more first lobed extensions and the holes through the one or more second lobed extensions, wherein the one or more connecting members through the second portion of the mounting member which are capable of preventing slidable movement of the mounting member with respect to the rail section and the one or more connecting members through the one or more first lobed extensions are disposed generally perpendicular to one another.

Other embodiments include an apparatus for mounting an illumination device to a rail of a firearm or helmet, comprising a mounting member comprising a first portion integrated with the illumination device, and a second portion connectable to the first portion so that the cooperation of the first and second portions allows mounting of the illumination device to the rail, wherein the mounting member is shaped to cooperate with the shape of a rail section and to positionally retain the second portion of the mounting member on the rail section with respect to a y-axis and a z-axis of the rail when the mounting member is in a slidable relationship with the rail section, wherein at least a portion of the mounting member is locatable in one or more spaces between protrusions of the rail section to positionally retain the mounting member with respect to the x-axis of the rail and prevent slidable movement of the mounting member with respect to the rail section, the first portion of the mounting member comprises one or more first holes therein, the second portion of the mounting member comprises one or more second holes therein, the at least a portion of the mounting member locatable in the one or more spaces is capable of preventing slidable movement of the mounting member with respect to the rail section by cooperation with the one or more second holes through the second portion, and the one or more first and second holes are generally parallel to one another and aligned with one another.

Additional embodiments include an apparatus for mounting an illumination device to a rail of a firearm or helmet, comprising a mounting member comprising a first portion integrated with the illumination device, and a second portion connectable to the first portion so that the cooperation of the first and second portions allows mounting of the illumination device to the rail, wherein the mounting member is shaped to cooperate with the shape of a rail section and to positionally retain the second portion of the mounting member on the rail section with respect to a y-axis and a z-axis of the rail when the mounting member is in a slidable relationship with the rail section, and wherein the first portion of the mounting member and the illuminating device are the same piece. Other embodiments include an apparatus for mounting an illumination device to a rail of a firearm or helmet, comprising a mounting member comprising a first portion integrated with the illumination device, and a second portion connectable to the first portion so that the cooperation of the first and second portions allows mounting of the illumination device to the rail, wherein the mounting member is shaped to cooperate with the shape of a rail section and to positionally retain the second portion of the mounting member on the rail section with respect to a y-axis and a z-axis of the rail when the mounting member is in a slidable relationship with the rail section, wherein the second portion of the mounting member comprises a slidable portion shaped to cooperate with the shape of the rail section and to positionally retain the slidable portion on the rail section with respect to a y-axis and a z-axis of the rail when the slidable portion is engaged in a slidable relationship with the rail section, and an arm which is rotatable with respect to the slidable portion, the arm pivotally connectable to the first portion of the mounting member, wherein the second portion of the mounting member further comprises a ball joint member around which the arm is rotatable with respect to the slidable portion, and wherein the slidable portion of the mounting member comprises a first member having a first cutout portion, and a second member having a second cutout portion, the first and second members being shaped to slide in a cutout portion of the rail section and cooperate with the shape of the cutout portion so that the rail section cutout portion retains the first and second members therein with respect to the y-axis and z-axis of the rail.

Yet further embodiments include an apparatus for mounting an illumination device to a rail of a firearm or helmet, comprising a mounting member comprising a first portion integrated with the illumination device, and a second portion connectable to the first portion so that the cooperation of the first and second portions allows mounting of the illumination device to the rail, wherein the mounting member is shaped to cooperate with the shape of a rail section and to positionally retain the second portion of the mounting member on the rail section with respect to a y-axis and a z-axis of the rail when the mounting member is in a slidable relationship with the rail section, wherein the second portion of the mounting member comprises a slidable portion shaped to cooperate with the shape of the rail section and to positionally retain the slidable portion on the rail section with respect to a y-axis and a z-axis of the rail when the slidable portion is engaged in a slidable relationship with the rail section, and an arm which is rotatable with respect to the slidable portion, the arm pivotally connectable to the first portion of the mounting member, wherein the second portion of the mounting member further comprises a ball joint member around which the arm is rotatable with respect to the slidable portion, and wherein the slidable portion of the mounting member comprises a first member having a first cutout portion, and a second member having a second cutout portion, the first and second members being shaped to slide in a cutout portion of the rail section and cooperate with the shape of the cutout portion so that the rail section cutout portion retains the first and second members therein with respect to the y-axis and z-axis of the rail, wherein uppermost and lowermost surfaces of the first and second members are generally dovetail shaped to slidingly engage with the rail section cutout portion and become retained therein. Even further embodiments include an apparatus for mounting an illumination device to a rail of a firearm or helmet, comprising a mounting member comprising a first portion integrated with the illumination device, and a second portion connectable to the first portion so that the cooperation of the first and second portions allows mounting of the illumination device to the rail, wherein the mounting member is shaped to cooperate with the shape of a rail section and to positionally retain the second portion of the mounting member on the rail section with respect to a y-axis and a z-axis of the rail when the mounting member is in a slidable relationship with the rail section, wherein the second portion of the mounting member comprises a slidable portion shaped to cooperate with the shape of the rail section and to positionally retain the slidable portion on the rail section with respect to a y-axis and a z-axis of the rail when the slidable portion is engaged in a slidable relationship with the rail section, and an arm which is rotatable with respect to the slidable portion, the arm pivotally connectable to the first portion of the mounting member, wherein the second portion of the mounting member further comprises a ball joint member around which the arm is rotatable with respect to the slidable portion, and wherein the slidable portion of the mounting member comprises a first member having a first cutout portion, and a second member having a second cutout portion, the first and second members being shaped to slide in a cutout portion of the rail section and cooperate with the shape of the cutout portion so that the rail section cutout portion retains the first and second members therein with respect to the y-axis and z-axis of the rail, wherein the first and second cutout portions of the first and second members rotationally engage the ball joint member to allow rotation of the arm with respect to the slidable member upon connection of the first and second members to one another, and wherein the arm and ball joint each comprise one or more holes therethrough so that when the ball joint is disposed in the arm, it is lockable in rotational position with respect to the slidable member upon aligning the one or more holes in the ball joint with one or more holes in the arm and inserting one or more connecting members through the one or more holes in each of the arm and ball joint.

Embodiments also may include an apparatus for mounting an illumination device to a rail of a firearm or helmet, comprising a mounting member comprising a first portion integrated with the illumination device, and a second portion connectable to the first portion so that the cooperation of the first and second portions allows mounting of the illumination device to the rail, wherein the mounting member is shaped to cooperate with the shape of a rail section and to positionally retain the second portion of the mounting member on the rail section with respect to a y-axis and a z-axis of the rail when the mounting member is in a slidable relationship with the rail section, wherein the second portion of the mounting member comprises a slidable portion shaped to cooperate with the shape of the rail section and to positionally retain the slidable portion on the rail section with respect to a y-axis and a z-axis of the rail when the slidable portion is engaged in a slidable relationship with the rail section, and an arm which is rotatable with respect to the slidable portion, the arm pivotally connectable to the first portion of the mounting member, wherein the second portion of the mounting member further comprises a ball joint member around which the arm is rotatable with respect to the slidable portion, and wherein the slidable portion of the mounting member comprises a first member having a first cutout portion, and a second member having a second cutout portion, the first and second members being shaped to slide in a cutout portion of the rail section and cooperate with the shape of the cutout portion so that the rail section cutout portion retains the first and second members therein with respect to the y-axis and z-axis of the rail, wherein the first and second cutout portions of the first and second members rotationally engage the ball joint member to allow rotation of the arm with respect to the slidable member upon connection of the first and second members to one another, the second portion of the mounting member further comprising one or more holes through the second portion of the mounting member, and one or more first lobed extensions extending therefrom comprising one or more holes therethrough, the one or more holes through the one or more first lobed extensions being generally perpendicular to the one or more holes through the second portion of the mounting member, wherein the first portion of the mounting member comprises one or more second lobed extensions from the illuminating device, the one or more second lobed extensions from the illuminating device having one or more holes extending therethrough, the central axes of the one or more holes through the one or more second lobed extensions being generally parallel to the central axis of the illuminating device, the apparatus further comprising one or more pivot point members extending through the holes through the first lobed extensions and second lobed extensions when the one or more cooperating holes through the first and second lobed extensions are generally aligned with one another to allow pivoting of the illuminating device and first portion of the mounting member with respect to the second portion of the mounting member, wherein the one or more pivot point members comprise one or more connecting members, and wherein the one or more connecting members are capable of locking the illuminating device into position with respect to the second portion of the mounting member upon their threading into the holes through the one or more first lobed extensions and the holes through the one or more second lobed extensions Some embodiments include an illumination device mount which has multi-axis positional and movement capability. Some embodiments include an illumination device mount which allows low profile positioning of the illumination device with respect to the firearm rail or helmet rail. Some embodiments include an illumination device mount having integrated mounting into the flashlight body. Some embodiments include an illumination device mount having hinged features to allow positioning of the illumination device with respect to the rail and/or firearm or helmet.

While the foregoing is directed to embodiments of the present invention, other and further embodiments of the invention may be devised without departing from the basic scope thereof, and the scope thereof is determined by the claims that follow.

The invention claimed is:

1. An apparatus for mounting an illumination device to a rail of a firearm or helmet, comprising:

a mounting member comprising:

a first portion integrated with the illumination device, and a second portion connectable to the first portion so that the cooperation of the first and second portions allows mounting of the illumination device to the rail, wherein the mounting member is shaped to cooperate with the shape of a rail section and to positionally retain the second portion of the mounting member on the rail section with respect to a y-axis and a z-axis of the rail when the mounting member is in a slidable relationship with the rail section, wherein:

the mounting member further comprises one or more connecting members which cooperate with one or more spaces between protrusions of the rail section to retain the mounting member with respect to the x-axis of the rail and prevent slidable movement of the mounting member with respect to the rail section, and the one or more connecting members tensionally connect the mounting member to the rail section by threading through one or more holes through the mounting member and into the one or more spaces between protrusions.

2. The apparatus of claim 1, wherein:

the first portion of the mounting member comprises one or more holes therein, the second portion of the mounting member comprises one or more holes therein, and the one or more connecting members are capable of preventing slidable movement of the mounting member with respect to the rail section upon their threading through the one or more holes through the first and second portions.

3. The apparatus of claim 1, wherein:

the one or more holes through the mounting member are one or more holes through the second portion of the mounting member, and the second portion of the mounting member further comprises one or more first lobed extensions therefrom comprising one or more holes therethrough, the one or more holes through the one or more first lobed extensions being generally perpendicular to the one or more holes through the second portion of the mounting member.

4. The apparatus of claim 3, wherein the first portion of the mounting member comprises one or more second lobed extensions from the illuminating device, the one or more second lobed extensions from the illuminating device having one or more holes extending therethrough, the central axes of the one or more holes through the one or more second lobed extensions being generally parallel to the central axis of the illuminating device, and further comprising one or more pivot point members extending through the holes through the first lobed extensions and second lobed extensions when the one or more cooperating holes through the first and second lobed extensions are generally aligned with one another to allow pivoting of the illuminating device and first portion of the mounting member with respect to the second portion of the mounting member.

5. An apparatus for mounting an illumination device to a rail of a firearm or helmet, comprising:

a mounting member comprising:

a first portion integrated with the illumination device, and a second portion connectable to the first portion so that the cooperation of the first and second portions allows mounting of the illumination device to the rail, wherein the mounting member is shaped to cooperate with the shape of a rail section and to positionally retain the second portion of the mounting member on the rail section with respect to a y-axis and a z-axis of the rail when the mounting member is in a slidable relationship with the rail section, wherein at least a portion of the mounting member is locatable in one or more spaces between protrusions of the rail section to positionally retain the mounting member with respect to the x-axis of the rail and prevent slidable movement of the mounting member with respect to the rail section, wherein:

the first portion of the mounting member comprises one or more first holes therein, the second portion of the mounting member comprises one or more second holes therein, and the at least a portion of the mounting member locatable in the one or more spaces is capable of preventing slidable movement of the mounting member with respect to the rail section by cooperation with the one or more second holes through the second portion.

6. The apparatus of claim 5, wherein:

the one or more first and second holes are generally parallel to one another and aligned with one another, and the at least a portion of the mounting member is located in the one or more spaces and through the one or more first and second holes to prevent slidable movement of the mounting member with respect to the rail section.

7. The apparatus of claim 5, wherein the one or more first and second holes are generally perpendicular to one another.

8. The apparatus of claim 7, wherein:

the at least a portion of the mounting member is located in the one or more spaces and through the one or more second holes to prevent slidable movement of the mounting member with respect to the rail section, and a pivot point is disposed through the one or more first holes and though additional corresponding holes through the second portion of the mounting member to allow pivoting of the first portion with respect to the second portion of the mounting member, the pivot point being generally perpendicular to the at least a portion of the mounting member located in the one or more spaces.

9. The apparatus of claim 8, wherein the pivot point allows positional rotation of the illuminating device with respect to the rail so that the illuminating device may be rotated to and locked into a low profile position below the rail section.

10. A method of mounting an illumination device to a rail for a firearm, comprising:

providing a mounting member comprising:

a first portion integrated with the illumination device, and a second portion connectable to the first portion so that the cooperation of the first and second portions allows mounting of the illumination device to the rail in a low profile position with respect to the rail, the second portion having one or more first holes therethrough, wherein the mounting member is shaped to cooperate with the shape of a rail section and to positionally retain the second portion of the mounting member on the rail section with respect to a y-axis and a z-axis of the rail when the mounting member is in a slidable relationship with the rail section;

positioning the mounting member on the rail section; and inserting one or more connecting members through one or more holes through the second portion of the mounting member and into one or more spaces between protrusions of the rail section to positionally secure the mounting member to the rail.

11. An apparatus for mounting an illumination device to a rail of a firearm or helmet, comprising:

a mounting member comprising:

a first portion integrated with and forming a part of the illumination device, and a second portion connectable to the first portion so that the cooperation of the first and second portions allows mounting of the illumination device to the rail, wherein the mounting member is shaped to cooperate with the shape of a rail section and to positionally retain the second portion of the mounting member on the rail section with respect to a y-axis and a z-axis of the rail when the mounting member is in a slidable relationship with the rail section, wherein at least part of the first portion is in direct contact with the rail section.

12. An apparatus for mounting an illumination device to a rail of a firearm or helmet, comprising:

a mounting member comprising:

a first portion integrated with and forming a part of the illumination device, and a second portion connectable to the first portion so that the cooperation of the first and second portions allows mounting of the illumination device to the rail, wherein the mounting member is shaped to cooperate with the shape of a rail section and to positionally retain the second portion of the mounting member on the rail section with respect to a y-axis and a z-axis of the rail when the mounting member is in a slidable relationship with the rail section, wherein the first portion is an extension of the illumination device and forms part of a rail grabber which connects the illumination device to the rail section.

13. An apparatus for mounting an illumination device to a rail of a firearm or helmet, comprising:

a mounting member comprising:

a first portion integrated with and forming a part of the illumination device, and a second portion connectable to the first portion so that the cooperation of the first and second portions allows mounting of the illumination device to the rail, wherein the mounting member is shaped to cooperate with the shape of a rail section and to positionally retain the second portion of the mounting member on the rail section with respect to a y-axis and a z-axis of the rail when the mounting member is in a slidable relationship with the rail section, wherein:

the mounting member allows low profile mounting of the illumination device so that the illumination device is located between a twelve o'clock and three o'clock position of the rail, between the three o'clock and six o'clock position of the rail, between the six o'clock position and nine o'clock position of the rail, or between the nine o'clock and the twelve o'clock position of the rail.

14. An apparatus for mounting an illumination device to a rail of a firearm or helmet, comprising:

a mounting member comprising:

a first portion integrated with and forming a part of the illumination device, and a second portion connectable to the first portion so that the cooperation of the first and second portions allows mounting of the illumination device to the rail, wherein the mounting member is shaped to cooperate with the shape of a rail section and to positionally retain the second portion of the mounting member on the rail section with respect to a y-axis and a z-axis of the rail when the mounting member is in a slidable relationship with the rail section, wherein the rail comprises a plurality of quadrants between a plurality of rail sections, and wherein the mounting member allows low profile mounting of the illumination device so that the illumination device is located in one or more of the plurality quadrants.

15. The apparatus of claim 14, wherein the plurality of quadrants are between a central y-axis and a central z-axis of the rail.

* * * * *